US005243360A

United States Patent [19]

Tomoda et al.

[11] Patent Number: 5,243,360

[45] Date of Patent: Sep. 7, 1993

[54] INK SHEET CARTRIDGE AND RECORDING APPARATUS UTILIZING THE SAME

[75] Inventors: Akihiro Tomoda; Minoru Yokoyama; Takashi Awai, all of Yokohama; Yasushi Ishida, Tokyo, all of Japan

[73] Assignee: Canon Kabushiki Kaisha, Tokyo, Japan

[21] Appl. No.: 472,851

[22] Filed: Jan. 31, 1990

[30] Foreign Application Priority Data

| | | | |
|---|---|---|---|
| Jan. 31, 1989 | [JP] | Japan | 1-9244[U] |
| Jan. 31, 1989 | [JP] | Japan | 1-9245[U] |
| Jan. 31, 1989 | [JP] | Japan | 1-9246[U] |
| Jan. 31, 1989 | [JP] | Japan | 1-19791 |
| Jan. 31, 1989 | [JP] | Japan | 1-19792 |
| Jan. 31, 1989 | [JP] | Japan | 1-19793 |
| Jan. 31, 1989 | [JP] | Japan | 1-19794 |
| Jan. 31, 1989 | [JP] | Japan | 1-19795 |
| Jan. 31, 1989 | [JP] | Japan | 1-19796 |
| Jan. 31, 1989 | [JP] | Japan | 1-19797 |
| Jan. 31, 1989 | [JP] | Japan | 1-19798 |
| Jan. 25, 1990 | [JP] | Japan | 2-13687 |

[51] Int. Cl.[5] ..... B41J 2/325; B41J 32/00

[52] U.S. Cl. ..... 346/76 PH

[58] Field of Search ..... 400/207, 208, 208.1, 400/120; 358/296, 298; 346/76 PH

[56] References Cited

U.S. PATENT DOCUMENTS

| | | | |
|---|---|---|---|
| 4,752,785 | 6/1988 | Isobe | 346/136 |
| 4,754,290 | 6/1988 | Kitayama et al. | 358/76 PH |
| 4,764,041 | 8/1988 | Bierhoff | 400/208 |
| 4,892,425 | 1/1990 | Shimizu et al. | 400/208 |
| 4,910,602 | 3/1990 | Sakuragi | 358/296 |

FOREIGN PATENT DOCUMENTS

| | | |
|---|---|---|
| 0203665 | 12/1986 | European Pat. Off. . |
| 59-199279 | 11/1984 | Japan . |
| 59-207254 | 4/1985 | Japan . |
| 63-205274 | 8/1988 | Japan . |
| 2162794 | 2/1986 | United Kingdom . |

OTHER PUBLICATIONS

Eur. Pat. Off. Search Rep. for Eur. Pat. App. No. 90101828.3.

*Primary Examiner*—Benjamin R. Fuller
*Assistant Examiner*—Huan Tran
*Attorney, Agent, or Firm*—Fitzpatrick, Cella, Harper & Scinto

[57] ABSTRACT

There is disclosed an ink sheet cartridge suitable for use in thermal transfer recording. The cartridge has a supply reel and a winding reel for the ink sheet, and a guide pin or pins protruding from the container of the cartridge. The guide pins serve as a guide in cartridge loading, thus facilitating the loading operation and securely determining the cartridge position, thus avoiding eventual disengagement of the reels from the power transmitting gears of the recording apparatus.

33 Claims, 21 Drawing Sheets

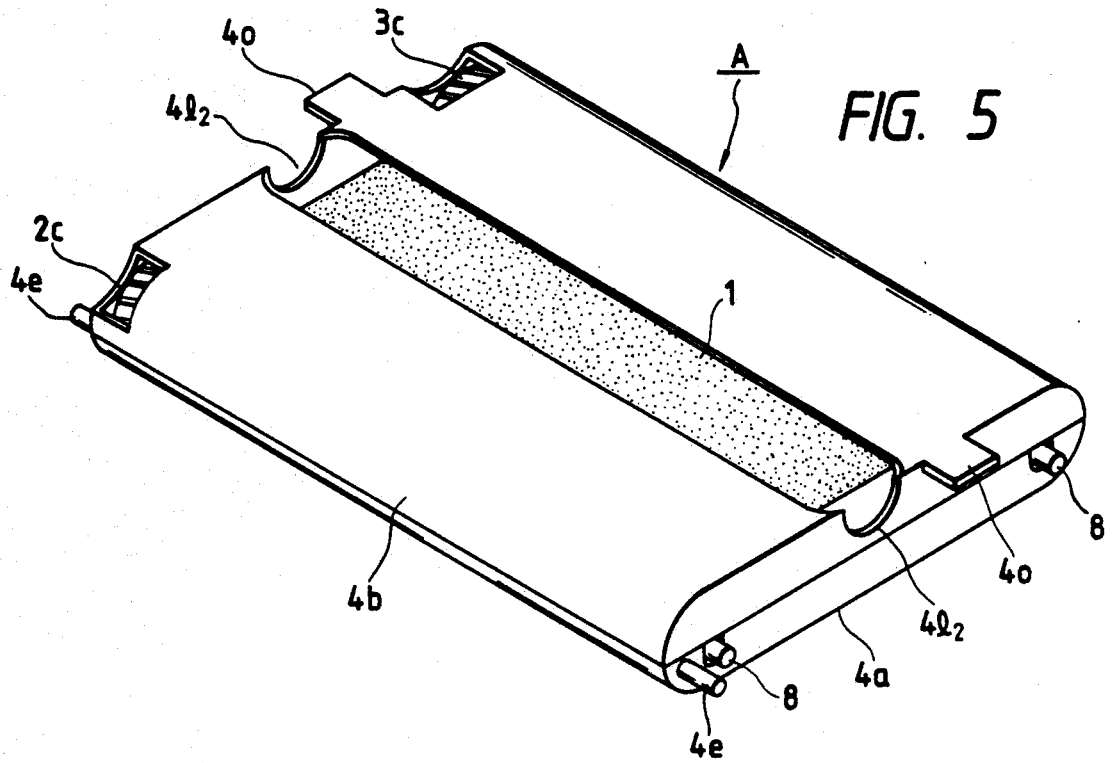
FIG. 5
FIG. 6
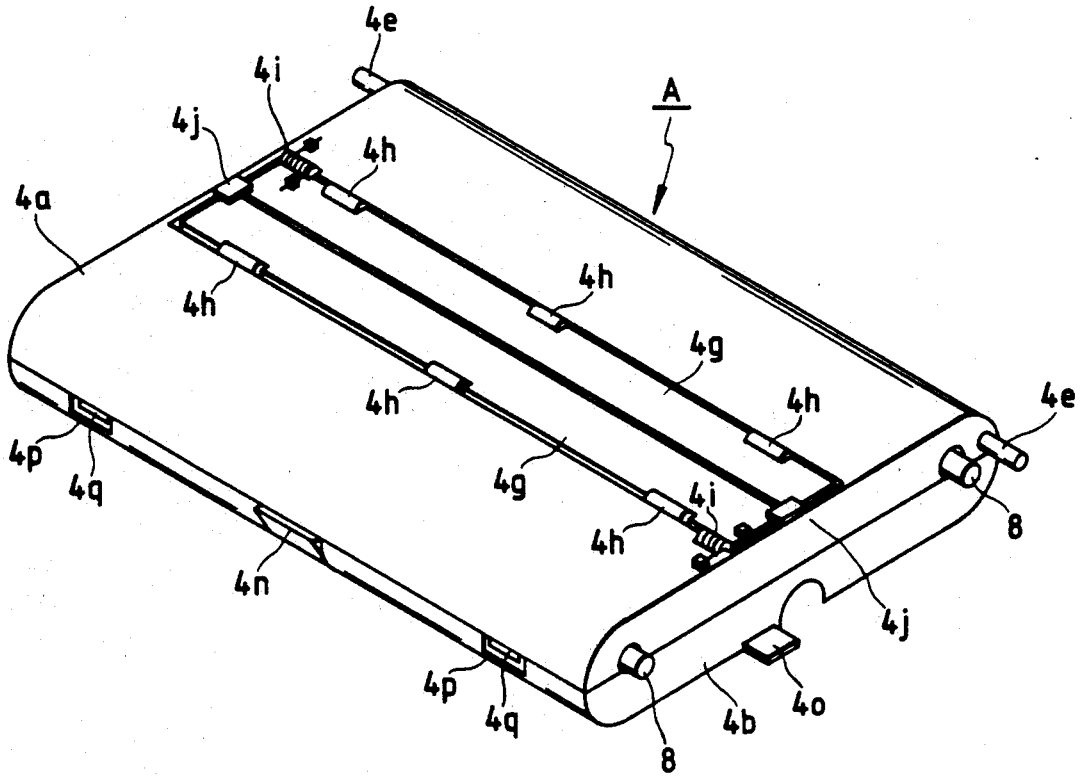

INK SHEET CARTRIDGE AND RECORDING APPARATUS UTILIZING THE SAME

BACKGROUND OF THE INVENTION

Field of the Invention

The present invention relates to an ink sheet cartridge incorporating an ink sheet, and a recording apparatus utilizing said ink sheet cartridge.

The recording apparatus includes a printer, an electronic typewriter, a word processor, a copying machine, a facsimile apparatus or the like.

Related Background Art

In the following description, a facsimile apparatus will be described as an example of the recording apparatus.

The facsimile apparatus are now widely used not only in the offices but also in ordinary home.

In such facsimile apparatus, for facilitating compactization, there is generally employed so-called thermal recording method utilizing a thermal recording sheet which develops color upon heating. In recent years, however, there have also been developed facsimile apparatus utilizing so-called thermal transfer recording method utilizing an ink sheet.

Such facsimile apparatus of the thermal transfer recording method has the advantages of employing an ordinary paper for the recording sheet and of clearer image recording.

However, the ink sheet is easily wrinkled because it is very thin. For this reason there has been required a cumbersome operation for loading the ink sheet in the recording apparatus, without causing wrinkles in the ink sheet. It has therefore been proposed to house the ink sheet in a cartridge and load the cartridge in the apparatus or detach it therefrom.

However, in loading into the recording apparatus, the cartridge has to be exactly positioned in relation to the recording head and the platen roller of the recording apparatus, and there has inevitably been required a complex positioning mechanism on the ink sheet cartridge.

Also the cartridge has to be provided, in a predetermined position thereof, with an aperture for the insertion of the recording head, and the ink sheet is therefore exposed in the aperture. Consequently there result drawbacks of deposition, onto the ink sheet, of dusts entering through the aperture, and eventual damage to thus exposed ink sheet.

Furthermore, in the recording operation with the above-explained ink sheet cartridge loaded in the recording apparatus, the driving force has to be transmitted to a take-up reel for winding the advanced ink sheet. For this reason the take-up reel of the detachable cartridge has to be securely coupled with the driving system of the apparatus, and there is thus required a complex structure.

The recording operation with the ink sheet cartridge is conducted by passing the ink sheet and a recording sheet between the recording head and the platen roller, and selectively generating heat by the heat generating elements of the recording head thereby transferring the ink from the ink sheet to the recording sheet. In such operation, there may result a lost portion in the transferred image unless the recording head is pressed to the platen roller with a predetermined pressure.

On the other hand, in the ink sheet cartridge, the ink sheet is fed from a supply reel to a take-up reel under a certain tension, in order to prevent wrinkle formation in the ink sheet, and the tension may bias the recording head in a direction opposite to the direction of the above-mentioned pressure toward the platen roller. For this reason the pressure between the recording head and the platen roller may fluctuate, thus deteriorating the quantity of image recording.

Furthermore, the conventional ink sheet cartridge has been associated with drawbacks of difficulty of ink sheet loading into the cartridge, and difficulty of connection of the ink sheet to the take-up reel in case the ink sheet is eventually broken for some reason.

SUMMARY OF THE INVENTION

An object of the present invention is to provide an ink sheet cartridge enabling exact positioning in the recording apparatus, in loading into the recording apparatus, and a recording apparatus utilizing said ink sheet cartridge.

Another object of the present invention is to provide an ink sheet cartridge which, when loaded in the recording apparatus, can be securely coupled with a driving system of the apparatus thereby receiving the driving force therefrom, and a recording apparatus utilizing said ink sheet cartridge.

Still another object of the present invention is to provide an ink sheet cartridge capable of image recording of high quality, and a recording apparatus utilizing said ink sheet cartridge.

Still another object of the present invention is to provide an ink sheet cartridge capable of being exactly positioned in the recording apparatus with a simple structure and of satisfactory image recording, and a recording apparatus utilizing said ink sheet cartridge.

DESCRIPTION OF THE DRAWINGS

FIGS. 5 and 6 are external perspective views of the ink sheet cartridge;

FIGS. 14A, 14B, 15, 16A, 16B, 17A, 17B, 18 and 19 are views of an embodiment in which a U-shaped positioning groove for a reel bearing is provided in the recording apparatus, wherein FIGS. 14A and 14B show a state of loading the ink sheet cartridge into the recording apparatus; FIGS. 15, 16A and 16B show a state with closed recording cover; FIGS. 17A and 17B show the relationship between the recording head and the cover in loading the ink sheet cartridge; FIG. 18 shows a recording state; and FIG. 19 shows an embodiment in which the feeding direction of the ink sheet is reversed.

DETAILED DESCRIPTION OF THE PREFERRED EMBODIMENTS

In the following there will be explained an ink sheet cartridge constituting a preferred embodiment of the present invention, and a facsimile apparatus as a recording apparatus utilizing said ink sheet cartridge.

1st Embodiment

Figure 1:
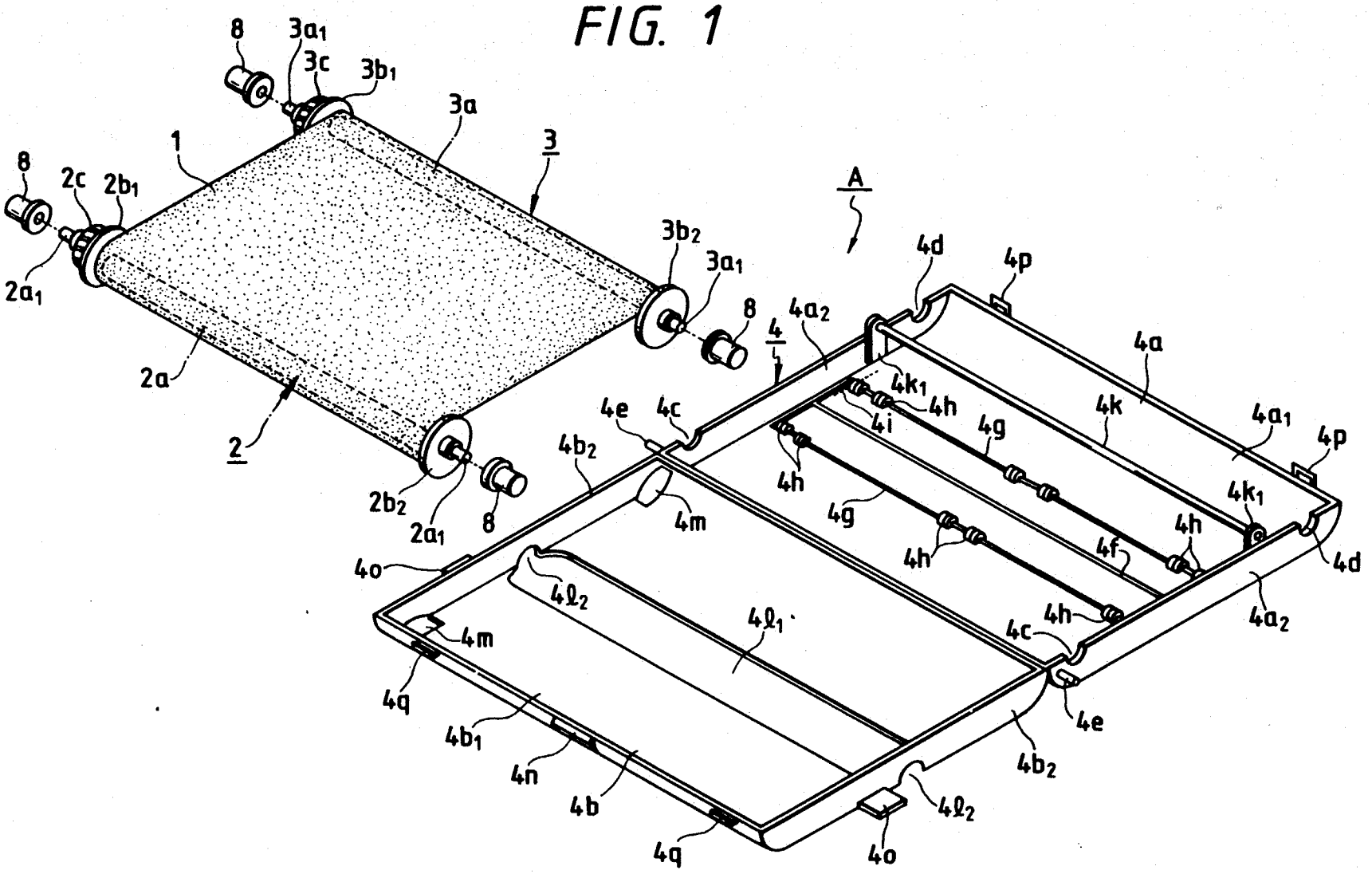
FIG. 1 is a schematic view of component parts of an ink sheet cartridge.
Figure 2:
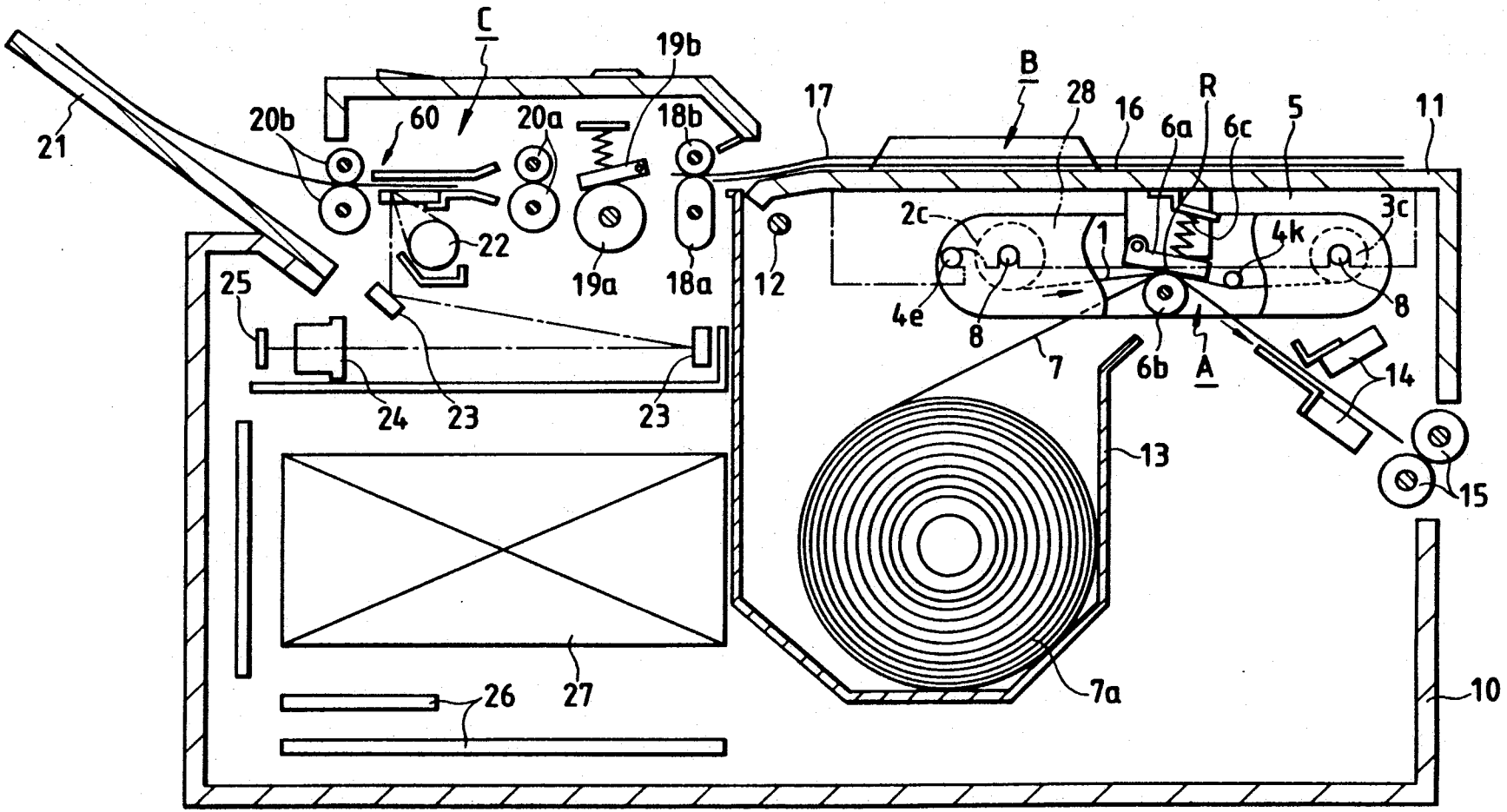
FIG. 2 is a cross-sectional view of a recording apparatus in which the ink sheet cartridge is loaded.

FIG. 1 is a schematic view showing the structure of an ink sheet cartridge A, and FIG. 2 is a schematic view of a recording apparatus (facsimile apparatus) B in which said ink sheet cartridge A is loaded.

In the ink sheet cartridge A, a continuous or elongated ink sheet 1 is wound on a supply reel 2 and a take-up reel 3, which are rotatably accommodated in a container 4. Said ink sheet cartridge A is so constructed as to be positioned and loaded in a loading part 5 of the recording apparatus B. While said ink sheet 1 and a recording sheet 7 are mutually superposed and are advanced in a recording unit provided with a recording head 6*a* and a platen roller 6*b*, the ink of said ink sheet 1 is transferred as an image pattern onto the recording sheet 7.

In the following the structure of said ink sheet cartridge A will be explained in greater detail.

The ink sheet 1 of the present embodiment has a width corresponding for example to the B4 or A4 size, and is composed of elongated substrate sheet coated thereon with thermal transfer ink (for example heat-fusible or heat-sublimable), wherein said ink is fused, when the substrate sheet is heated, according to the pattern of heating. Said ink sheet 1 itself can be of already known type. Said ink sheet 1 is wound, at an end thereof, on the supply reel 2, and, at the other end, on the take-up reel 3.

As shown in FIG. 1, shafts 2*a*, 3*a* of said supply reel 2 and take-up reel 3 are provided, at both ends thereof, with flanges $2b_1$, $2b_2$, $3b_1$, $3b_2$, and reel gears 2*c*, 3*c* for receiving the driving force are integrally formed on the flanges $2b_1$, $3b_1$.

The reel shafts 2*a*, 3*a* extend beyond said gears 2*c*, 3*c* and flanges $2b_2$, $3b_2$ to form end portions $2a_1$, $3a_1$, which are rotatably fitted in bearings 8. Said reels 2, 3 supporting the ink sheet 1 are housed in the container 4. Said bearings 8 are composed of a low friction material such as polyacetal, polyamide, polybutylene terephthalate etc. so that the reel shafts 2*a*, 3*a* can smoothly rotate in the bearings 8.

In the following there will be explained the structure of said container 4.

As shown in FIG. 1, said container 4 is composed of a first casing member 4*a* and a second casing member 4*b*, which are mutually linked by unrepresented hinges, so as to be opened or closed.

Said first casing member 4*a* is composed of a base plate $4a_1$ with curved ends, and vertical side plates $4a_2$ perpendicularly provided at both lateral ends. In predetermined positions of said side plates $4a_2$ there are provided two pairs of U-shaped grooves 4*c*, 4*d* with a predetermined gap therebetween. In the U-shaped grooves 4*c*, there are fitted the bearings 8 for the supply reel 2, while in the other grooves 4*d* there are fitted the bearings 8 for the take-up reel 3, whereby said supply reel 2 and take-up reel 3 are loaded in the first casing member 4*a*. Guide pins 4*e* for mounting the ink sheet cartridge A on the recording apparatus B are provided on said side plates $4a_2$, substantially on a line passing through said U-shaped grooves 4*c* and 4*d*, at an end close to said hinges. As will be explained later, said guide pins 4*e* serve as guide members and as rotating centers in loading the ink sheet cartridge A into the recording apparatus B.

In the present embodiment, the U-shaped grooves 4*c*, 4*d* are made larger than the bearings 8 by about 2 mm in the vertical direction and by about 0.5 mm in the longitudinal direction, in order that said bearings 8 are fitted with a certain play in said grooves. Therefore, in the ink sheet cartridge A of the present embodiment, when the casing members 4*a*, 4*b* are mutually closed with the bearings 8 fitted in the U-shaped grooves 4*c*, 4*d*, the line connecting the centers of said bearings 8 is positioned about 2 mm above the center of the guide pin 4*e*. Consequently, in the present embodiment, in loading the ink sheet cartridge A into the recording apparatus B, smooth positioning of the cartridge A is ensured as the bearings 8 almost simultaneously fit into U-shaped grooves 28*b*, 28*c* of positioning members 28. Said guide pin 4*e* is either positioned on the extention of a line connecting the centers of the bearings 8, or positioned within a distance of 10 mm from said extention, preferably 5 mm and most preferably 2.5 mm. Within said distance, the cartridge A can be more smoothly loaded in the recording apparatus. In the present embodiment, as will be explained later, the line connecting the centers of the bearings 8 substantially passes the center of the guide pin 4*e* when the loading of the cartridge A into the apparatus B is completed.

In a predetermined position of said base plate $4a_1$, at approximate center of the U-shaped grooves 4*c* and 4*d*, there is provided an aperture 4*f* for enabling insertion of the recording head 6*a* when loaded in the recording apparatus B, and said aperture 4*f* is provided with hinged covers 4*g*. Each of said covers 4*g* is rotatably mounted on the base plate $4a_1$ by means of hinges 4*h*, and a torsion coil spring 4*i* provided at an end of said cover 4*g* biases said cover 4*g* toward the outside. In predetermined positions of said base plate $4a_1$, there are provided, as shown in FIG. 6, limiting plates 4*j* for limiting by the torsion coil spring 4*i* from biasing the cover 4*g* in an open direction.

Inside said side plates $4a_2$ and in the vicinity of the loading position of the take-up reel 3, there are provided upright members $4k_1$, supporting a guide shaft 4*k* for guiding the movement of the ink sheet 1 as will be explained later. Instead, said guide shaft 4*k* may be provided on a recording cover 11 of the apparatus.

As in the first casing member 4*a* explained above, the second casing member 4*b* is composed of a base plate $4b_1$ with curved ends and vertical side plates $4b_2$. At the approximate center of said base plate $4b_1$, there is provided an aperture $fl_1$ for allowing entry of the platen roller 6*b* when the cartridge A is loaded in the apparatus B, and said aperture $4l_1$ is continued to notches $4l_2$ formed in the side plates $4b_2$ for accommodating the platen roller shaft.

Also in predetermined positions of said base plate $4b_1$, there are formed apertures 4m for exposing the gears 2c, 3c of the supply and take-up reels 2, 3 housed in the container 4. Said gears 2c, 3c exposed in the apertures 4m mesh with a driving gear 31 linked with a motor of the recording apparatus B, whereby the rotating power is transmitted to the reels 2, 3.

An engaging projection 4n is provided in a predetermined position at the open end of said second casing member 4b, and the ink sheet cartridge A can be loaded into the recording apparatus B by fitting said engaging projection 4n with an engaging spring of a loading part 5. Outwardly extending grips 4o are formed on the side plates $4b_2$ of the second casing member 4b and can be used by the operator for disengaging said projection 4n from the engaging spring, in case of detaching the ink sheet cartridge A from the apparatus B.

The first casing member 4a is provided with recessed engaging portions 4p at the open end thereof, while the second casing member 4b is provided with matching engaging projections 4q at the open end thereof, whereby, in the closed state of the casing members 4a, 4b, said recessed engaging portions 4p and the engaging projections 4q mutually engage to maintain the closed state.

The ink sheet 1 can be loaded into the container 4 in the following manner.

Figure 3:
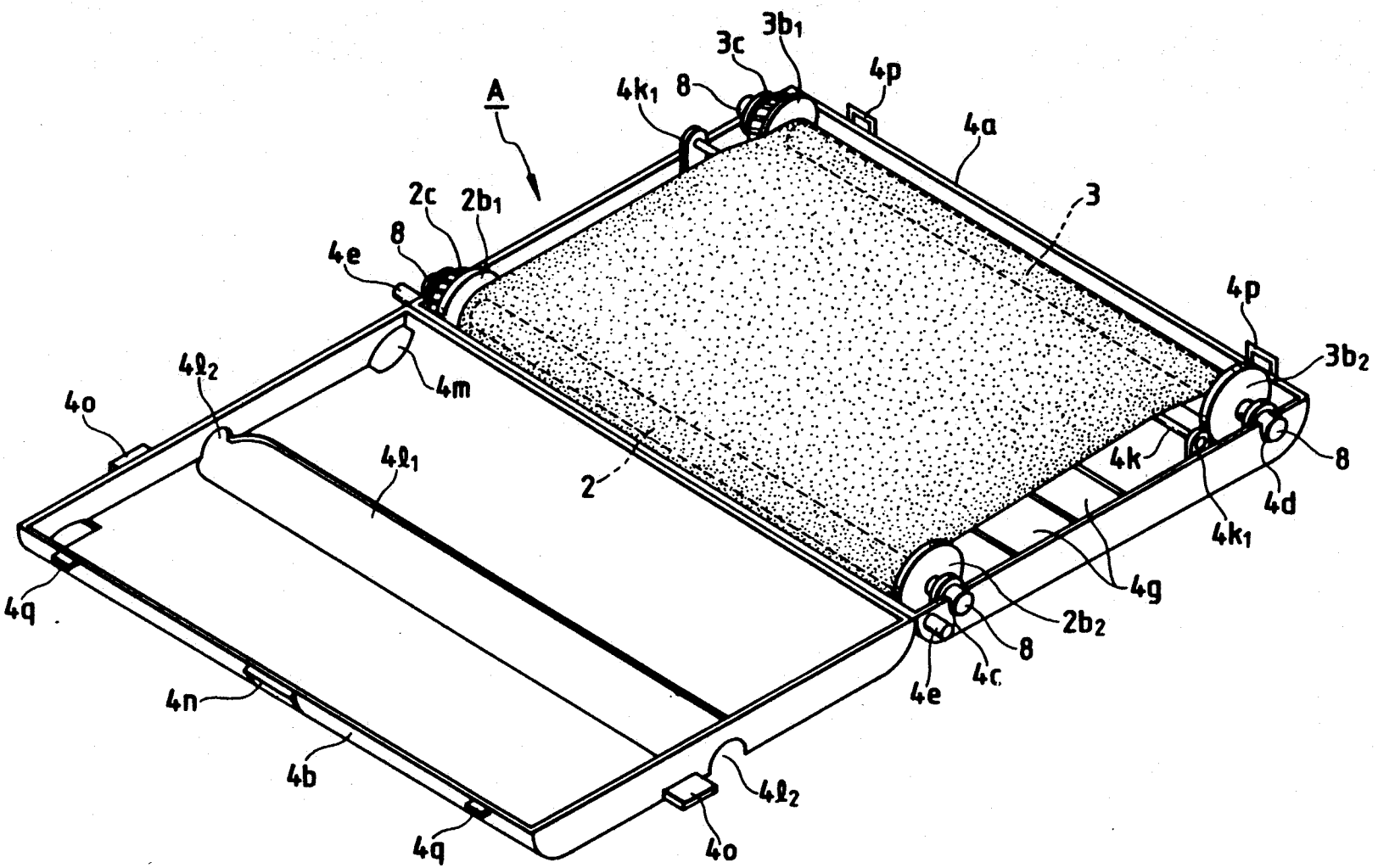
FIG. 3 is a perspective view of the ink sheet cartridge with an ink sheet loaded therein.

The bearings 8 are fitted on both ends of the supply reel 2 and the take-up reel 3 supporting the ink sheet 1 as shown in FIG. 1, and are fitted in the U-shaped grooves 4c, 4d of the first casing member 4a. The ink sheet 1 is so set that it is wound on the take-up reel 3 from above to below, or clockwise in FIG. 3.

Figure 4:
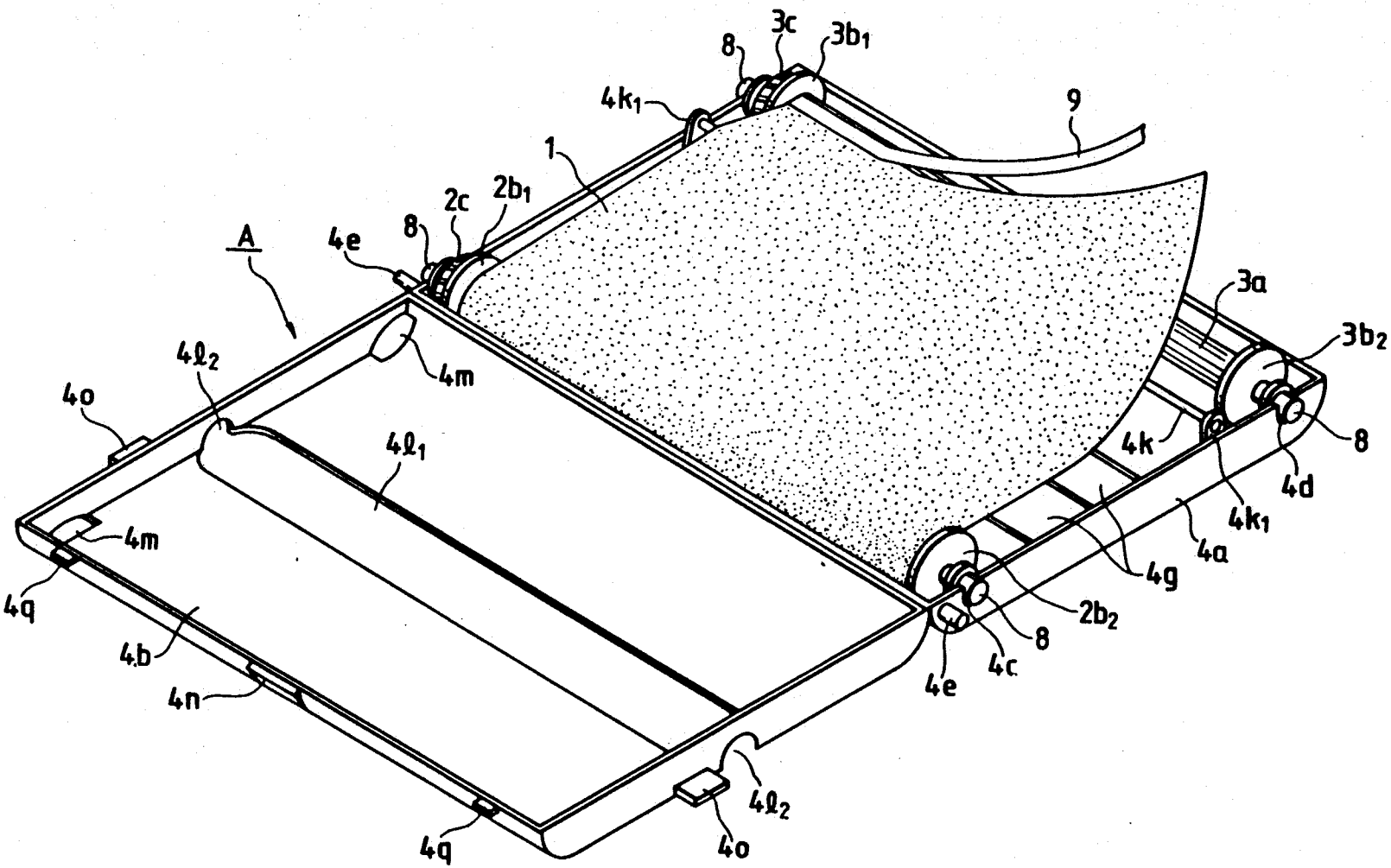
FIG. 4 is a perspective view of a state of adhering the ink sheet to a take-up reel.

In such sheet setting, the front end of the ink sheet 1, when it is eventually broken, can be directly adhered onto the upper part of the take-up reel shaft 3a for example with an adhesive tape 9 as shown in FIG. 4. On the other hand, if the ink sheet is so set that it is wound on the take-up reel 3 anticlockwise, namely from below to above, the front end of the broken ink sheet 1 has to be threaded under the take-up reel 3 before it is adhered to said reel Thus the above-explained setting of the ink sheet 1 in the first casing member 4a facilitates the splicing operation in case of breakage. Also in the present embodiment, the U-shaped grooves 4c, 4d for accommodating the bearings 8 are only provided in the first casing member 4a, so that the ink sheet cannot be set in the second casing member 4b. It is therefore possible to prevent erroneous inverse setting of the ink sheet 1 in the second casing member 4b, for example at maintenance. Nevertheless, said U-shaped grooves may be provided on both first casing member 4a and second casing member 4b.

After the supply reel 2 and the take-up reel 3 supporting the ink sheet 1 are set in the first casing member 4a, the second casing member 4b is rotated with respect to the first casing member 4a as shown in FIGS. 5 and 6, thereby causing mutual engagement of the engaging portions 4p and engaging projections 4q of the casing members 4a, 4b and maintaining the ink sheet cartridge A in the closed state.

The above-explained ink sheet cartridge A can prevent intrusion of dusts through the aperture 4f during storage or transportation, due to the presence of covers 4g in said aperture 4f. Also said covers prevent the ink sheet 1 from eventual damages, and serve to hide the interior thereby giving a high-classed appearance to the cartridge.

In the following there will be explained the structure of the recording apparatus B for thermal transfer recording with the ink sheet cartridge A loaded therein.

The recording apparatus B of the present embodiment is constructed as a facsimile apparatus equipped with an image reading unit C as shown in FIG. 2. Said apparatus can be opened by rotating a recording cover 11 about a hinge shaft 12 with respect to the main body 10, and said ink sheet cartridge A can be loaded in said recording cover 11.

In said main body 10 there are provided a roll holder 13 for drop-in loading of a roll 7a of a continuous recording sheet 7; a platen roller 6b serving as feeding means for feeding said recording sheet 7; a cutter 14 for cutting the recording sheet 7 after recording; and discharge rollers 15 for discharging the sheet 7 after cutting.

Figure 7A:
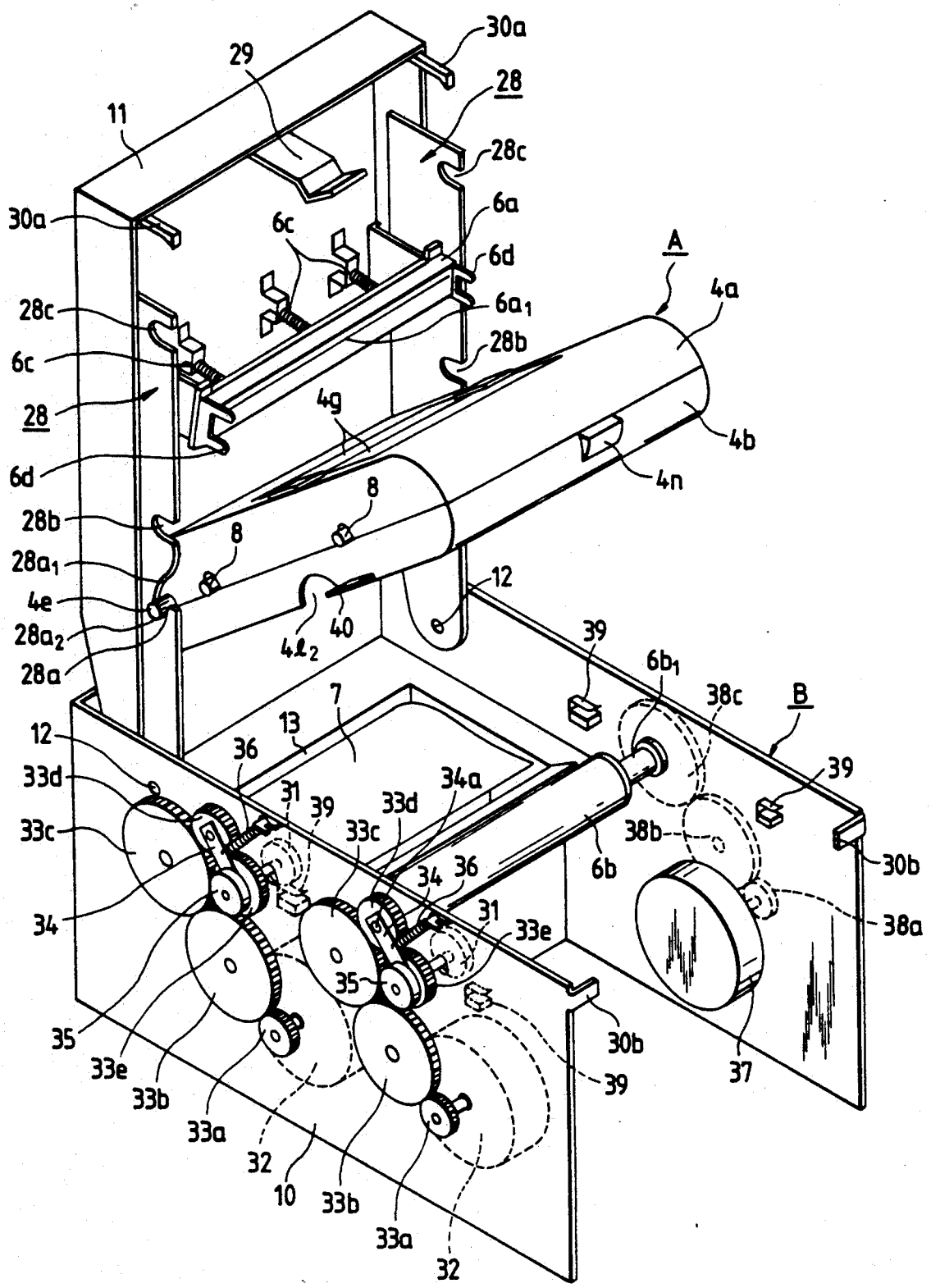
FIGS. 7A and 7B are perspective views of a state of loading the ink sheet cartridge into the recording apparatus.

In the recording cover 11 there is provided, as shown in FIGS. 2 and 7A, a line recording head 6a composed of a linear array, across the recording area, of heat generating elements $6a_1$ for generating heat according to image signals. When the recording cover 11 is closed, said recording head 6a is pressed against the platen roller 6b by means of the elastic force of a spring 6c, and fork members 6d fixed on both ends of said recording head 6a support the shaft $6b_1$ of the platen roller, thereby positioning the recording head 6a with respect to the roller 6b.

In the image reading unit C, plural original documents 17 can be stacked on an original stacker 16 formed on the upper face of the recording cover 11. Said plural originals 17 are preliminarily advanced by a preliminary feeding roller 18a and a pressure roller 18b, and are separated and advanced one by one, by means of a separating roller 19a and a pressing member 19b maintained in contact therewith. Said original document 17 is fed by paired transport rollers 20a, 20b for image reading in a reading unit to be explained later, and is discharged onto a tray 21 after said image reading. In the reading unit 60, the original document 17 is illuminated by a light source 22 while it is transported, and the reflected light is guided through mirrors 23 and a lens 24 to a photoelectric converting element 25 such as a CCD. The obtained image signal is supplied to a recording unit of the same apparatus in case of the copy mode, or to the recording unit of another apparatus in case of transmission mode.

In FIG. 2, there are also shown a printed circuit board 26, and a power source 27 for driving motors and other components.

Figure 8:
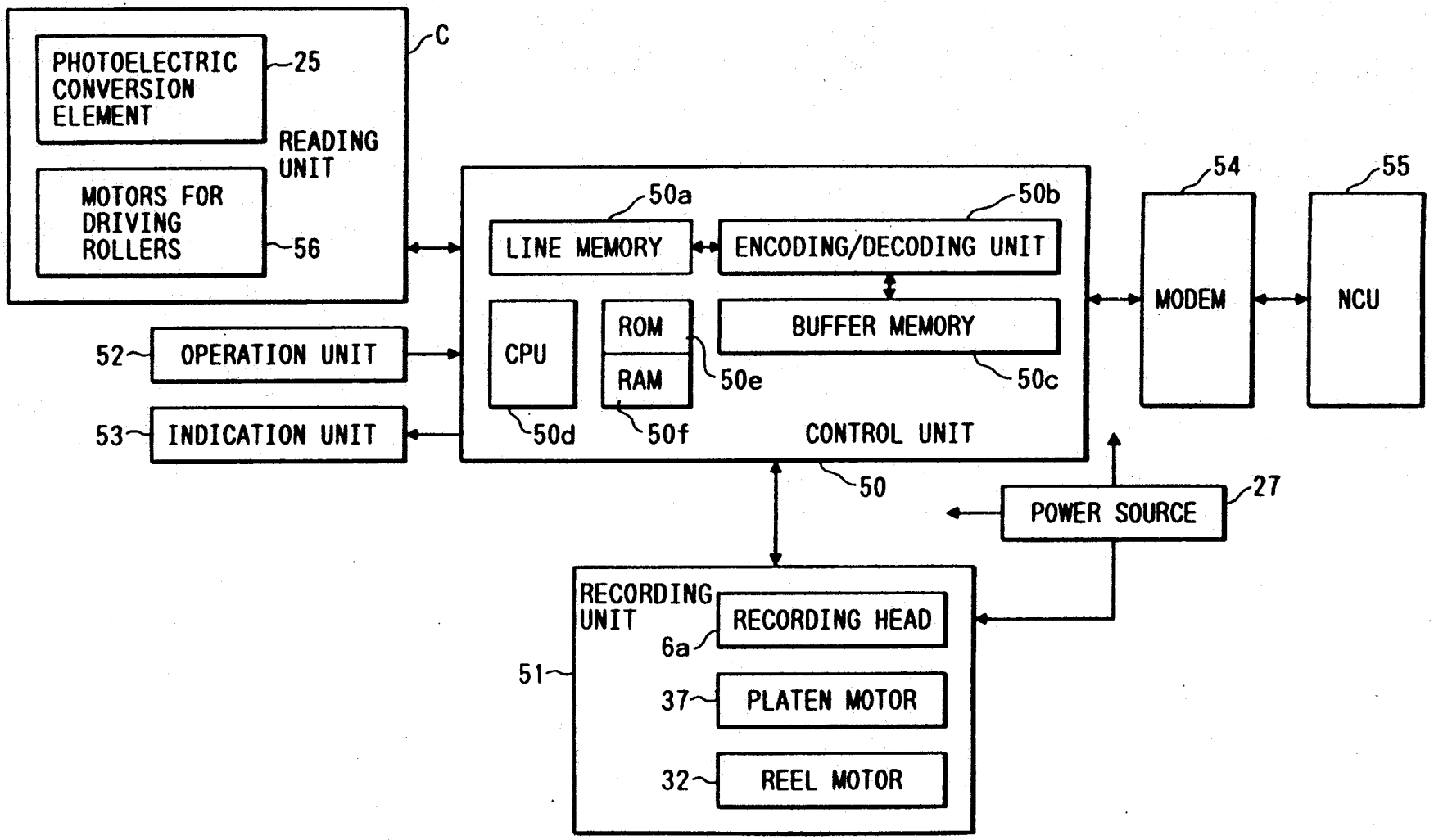
FIG. 8 is a block diagram of a control system.

FIG. 8 is a block diagram showing the control system for controlling the above-explained apparatus.

The image reading unit C is provided with a photoelectric converting element 25 explained above, and a motor 56 for driving the preliminary feeding roller 16 and transport rollers 20a, 20b. A line memory 50a in a control unit 50 stores the image data of each line, and serves to store the image data of a line from the image reading unit C in the copying or transmission of the original 17, or the received decoded image data of a line in case of reception of image data. The image recording is conducted by sending the data from said line memory 50a to the recording head 6a. An encoding/decoding unit 50b encodes the image data to be transmitted for example by MH encoding, and decoding the received encoded data into image data. A buffer memory 50c serves to store the encoded image data to be transmitted or data received. These components of the control unit 50 are controlled by a CPU 50*d* such as a microprocessor. The control unit 50 is further provided with a ROM 50*e* storing the control program of the CPU 50*d* and various data, and a RAM 50*f* for temporarily storing various data as a work area of the CPU 50*d*.

A recording unit 51 is provided with the aforementioned recording head 6*a* and motors (reel driving motor 32 and platen motor 37) to be explained later, which are driven by signals from the CPU 50*d*. There are also provided an operation unit 52 including various function keys such as a transmission start key and input keys for telephone numbers; and an indication unit 53 for displaying status of various functions of said operation unit 52 and of the apparatus.

There are further provided a modem 54; and a network control unit (NCU) 55.

In the following explained is the structure of the loading unit 5 for loading the ink sheet cartridge A.

On both sides of the recording cover 11, as shown in FIG. 7A, there are symmetrically mounted positioning members 28, each of which is provided with a hooked groove 28*a* for engaging with the guide pin 4*e* of the ink sheet cartridge A, and U-shaped grooves 28*b*, 28*c* for engaging with the bearings 8 supporting the ends of the reels 2, 3 thereby defining the positions of said bearings 8, with predetermined spaces therebetween along a line. Also at the open end of said recording cover 11 there is provided an engaging spring 29 for engaging with the projection 4*n* of the ink sheet cartridge A.

Thus, in loading the ink sheet cartridge A into the cover 11 of the apparatus, the guide pin 4*e* of said cartridge A is moved along a sloped portion $28a_1$ of the hooked groove 28*a* until it engages with a groove portion $28a_2$ as shown in FIG. 7A. The cartridge A can be loaded in the recording cover 11 by then rotating said cartridge A about the guide pin 4*e* fitted in said hooked groove 28*a* until the engaging projection 4*n* engages with the spring 29. In this state the bearings 8 respectively fit into the U-shaped grooves 28*b*, 28*c*.

Figure 7B:
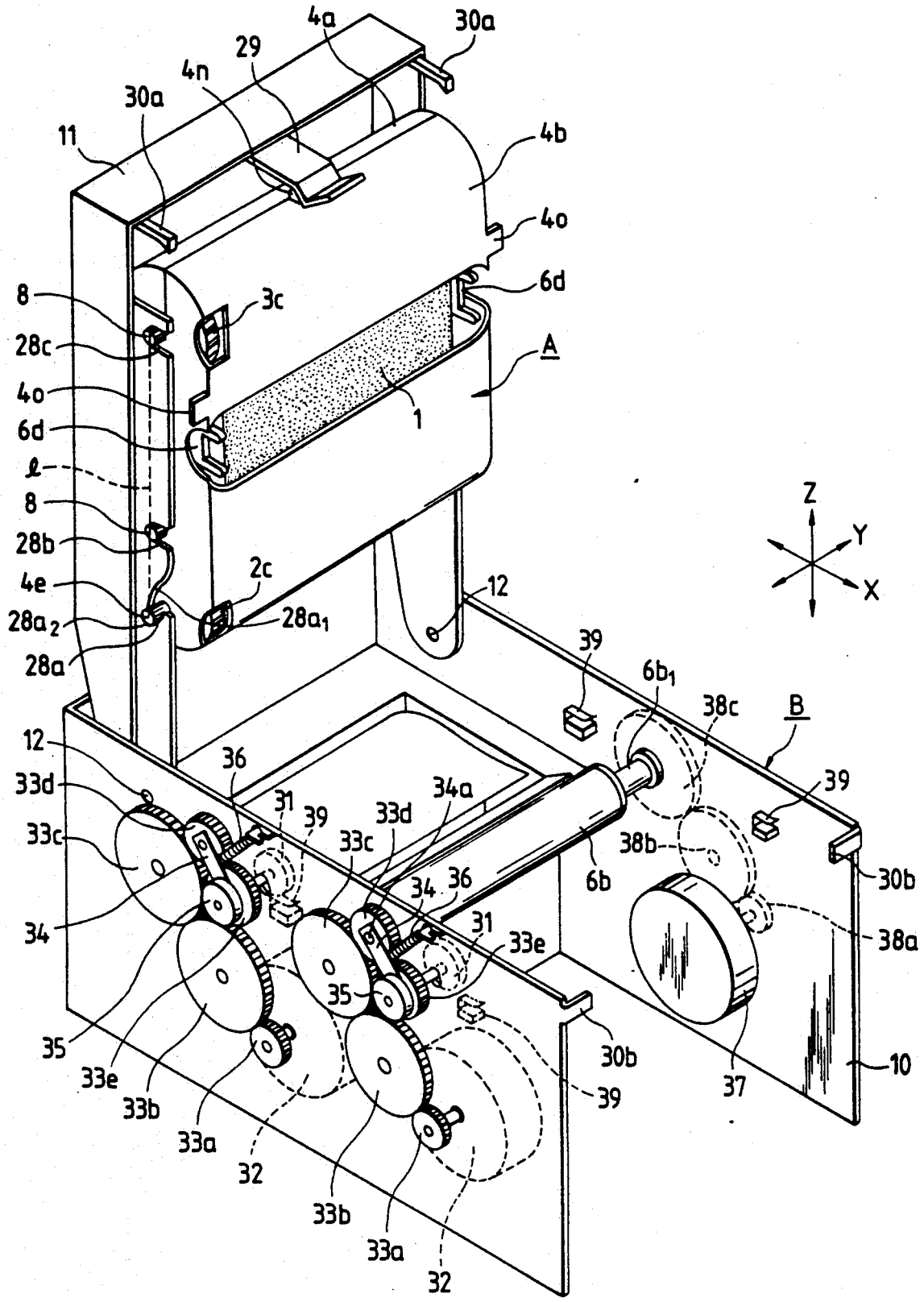

When the loading is completed, the center of the guide pin 4*e* of the ink sheet cartridge A and the centers of the bearings 8 fitted in the U-shaped grooves 4*c*, 4*d* substantially lie on a line (dotted line l in FIG. 7B or 19B, so that, when the cartridge A is rotated about the guide pin 4*e*, the bearings 8 of the supply reel 2 and the take-up reel 3 are substantially simultaneously fitted in the U-shaped grooves 28*b*, 28*c* of the positioning member 28. Consequently the bearings 8 can be securely positioned in the U-shaped grooves 28*b*, 28*c*, without either one fitting fitted in the groove at first and functioning as the center of rotation.

Also in the present embodiment, said guide pin 4*e* and the U-shaped grooves 4*c*, 4*d* for accommodating the bearings 8 are all provided on the first casing member 4*a*, and the center of said pin 4*e* and the centers of arcs of the grooves 4*c*, 4*d* are positioned substantially along a line, though they are not completely aligned linearly as the bearings 8 are fitted in said U-shaped grooves 4*c*, 4*d* with a play of 2–3 mm. Thus the bearings 8 can be exactly positioned with respect to the guide pin 4*e*, by substantially linearly arranging the center of arc of the groove $28a_2$ of the hooked groove 28*a* and the centers of arcs of the U-shaped grooves 28*b*, 28*c* to be formed on the positioning member 28. Stated differently, the bearings 8 can be positioned with a high precision, by a simple structure of arranging the hooked groove 28*a* and the U-shaped grooves 28*b*, 28*c* substantially linearly on the same positioning member 28.

Figure 9A:
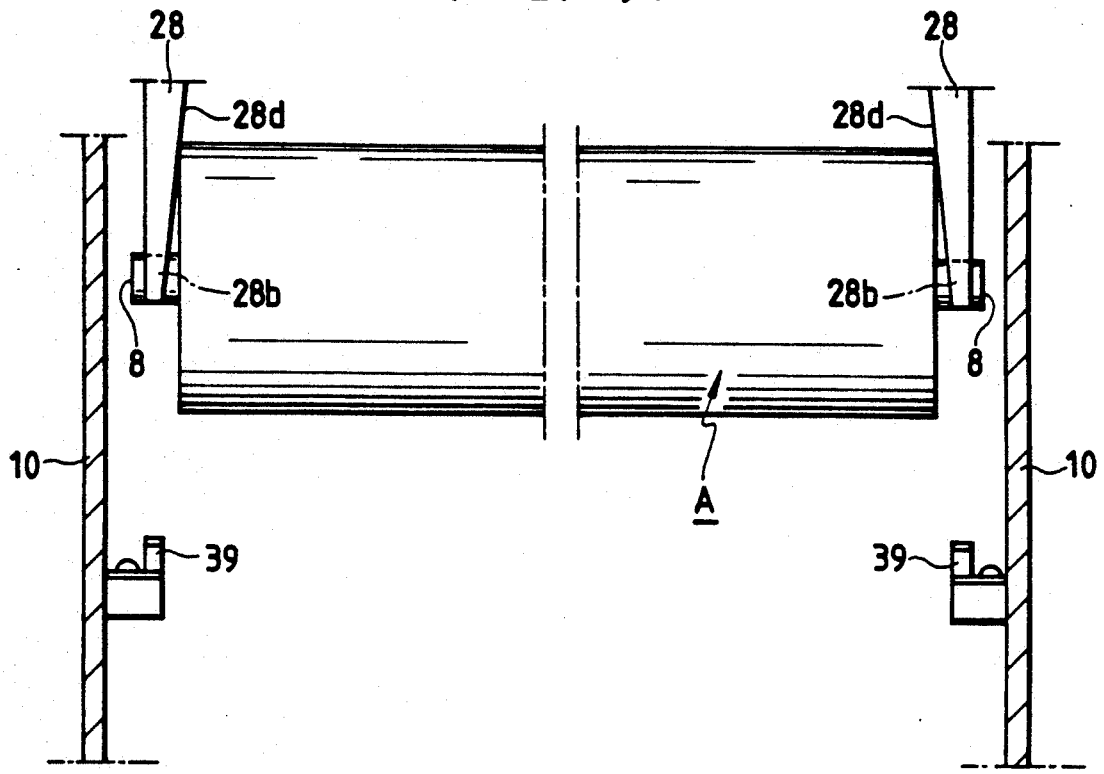
FIGS. 9A and 9B are cross-sectional views of a state in which the ink sheet cartridge is mounted on positioning members and a recording cover is closed.

As shown in FIG. 9A, the positioning member 28 of the present embodiment is tapered in thickness in such a manner that the distance between the internal faces 28*d* is wider in the lower position and becomes narrower at the upper position. Thus said ink sheet cartridge A, when rotated about the guide pin 4*e*, is guided along said tapering, so that the loading is facilitated and the cartridge A can be maintained without play in the direction of reel shaft (direction Y in FIG. 7B) after loading.

Figure 10A:
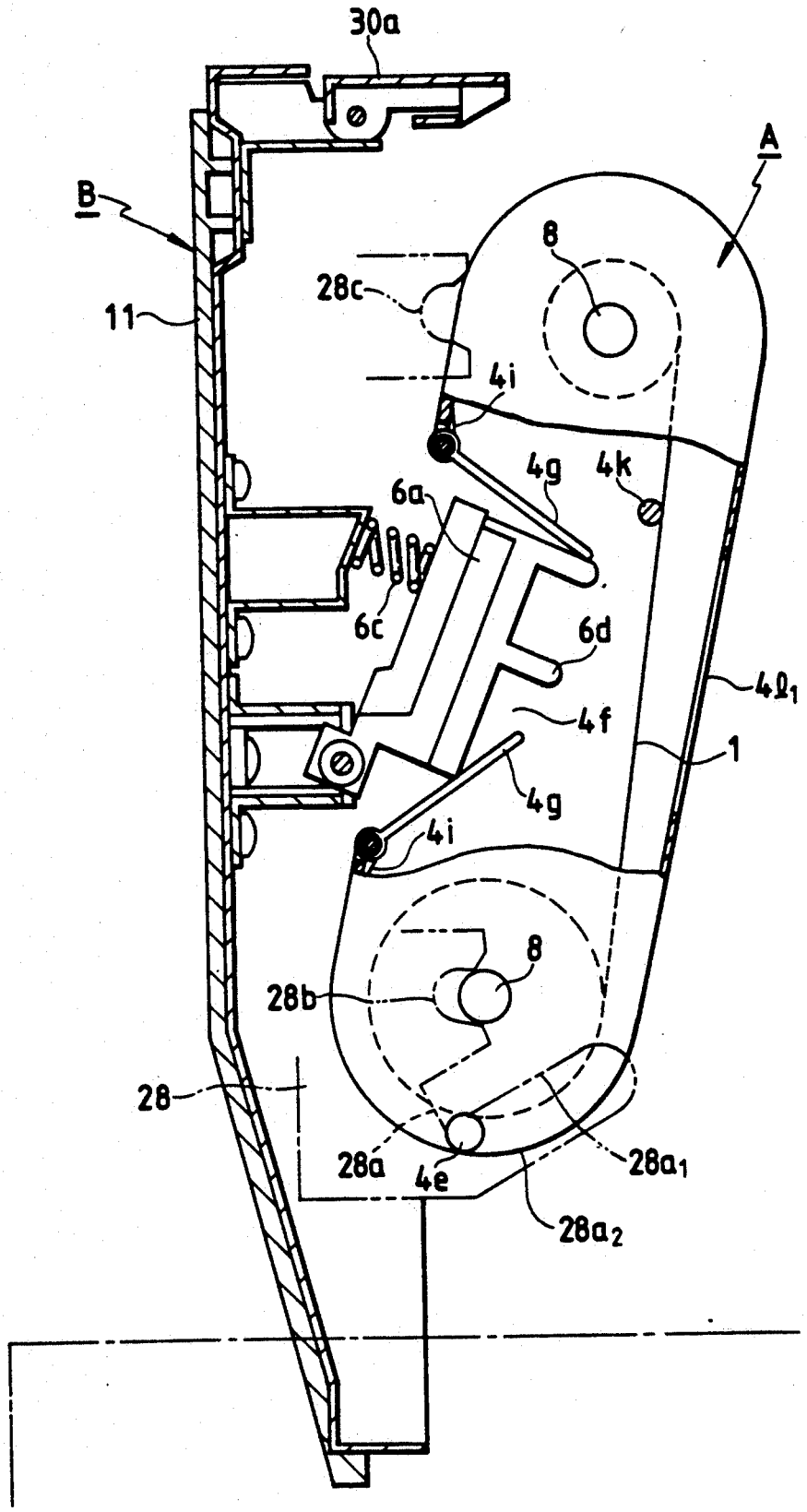
FIGS. 10A and 10B are cross-sectional views showing the relationship between the recording head and a cover member in the loading of the ink sheet cartridge.
Figure 10B:
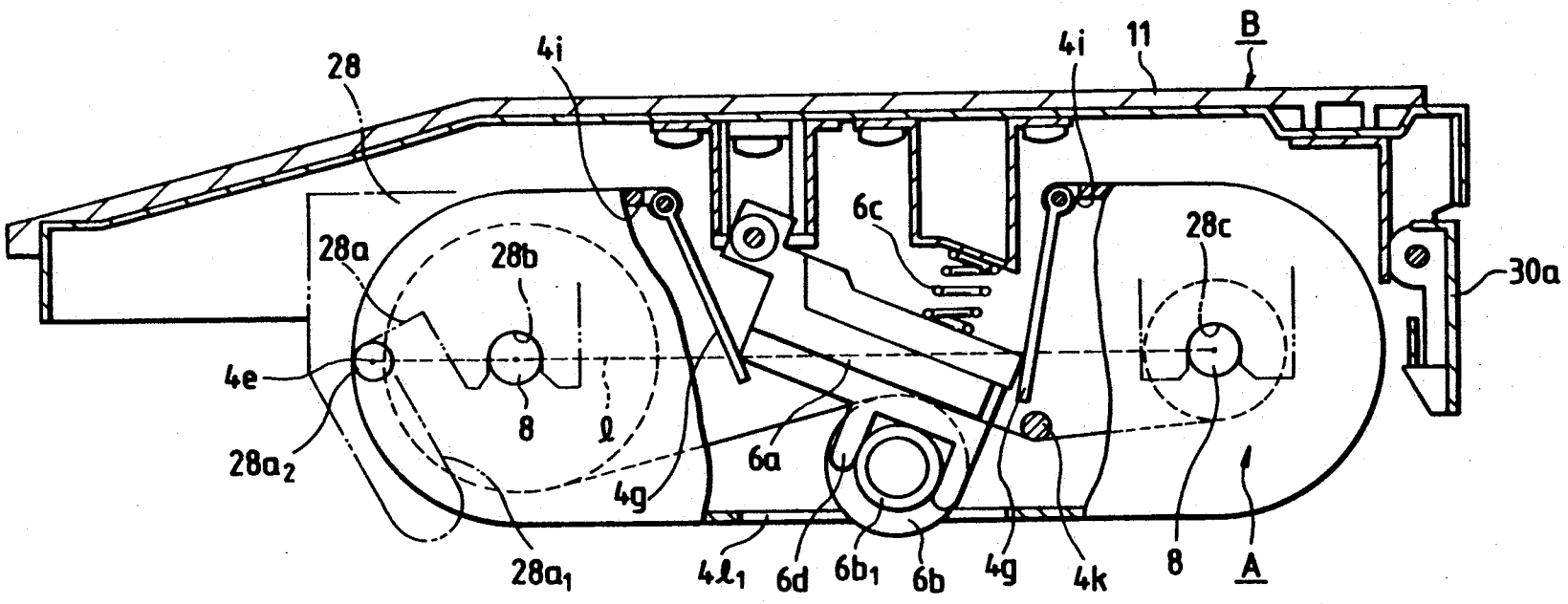

Also at the loading of the ink sheet cartridge A explained above, a fork member 6*d* mounted on the recording head 6*a* pushes open the covers 4*g* of the cartridge A against the force of the torsion coil springs 4*i* as shown in FIGS. 10A and 10B, whereby the recording head 6*a* enters the interior of the cartridge A through the aperture 4*f* thereof.

Since said aperture 4*f* is provided at the approximate center between the reels 2 and 3, the covers 4*g* opened by the fork member 6*d* of the recording head 6*a* can be of a simple planar structure without touching the ink sheet 1 wound on the reels 2, 3, so that the freedom in designing is increased. It is also possible to compactize the ink sheet cartridge by designing the aperture 4*f*, substantially determined by the recording head 6*a* and the fork member 6*d* so as to satisfy various conditions, and still reducing the space between the reels 2 and 3 and minimizing the unnecessary spaces between the recording head 6*a* and the reels 2, 3.

Since the guide pin 4*e* is provided at the end of the cartridge A and is separated by a certain distance from the aperture 4*f*, said aperture 4*f* can be made as a minimum necessary size for inserting the recording head 6*a*.

The biasing force of the torsion coil springs 4*i* for returning the covers 4*g* is selected at a level not affecting the contact pressure of the recording head 6*a* on the platen roller 6*b* when said head 6*a* is inserted as shown in FIG. 10B. In the present embodiment, therefore, the contact pressure between the recording head 6*a* and the platen roller 6*d* by the spring 6*c* is selected approximately at 150 gf/cm, while the biasing force of said torsion coil springs 4*i* on the covers 4*g* is selected approximately at 60 gf/cm.

The loading of the ink sheet cartridge A can be easily done, as the recording head 6*a* automatically opens the covers 4*g* and is inserted into the cartridge A at said loading. Also since the covers 4*g* are opened to both sides by the pressure of the recording head 6*a*, there is required a small rotating radius for each cover, and the length of the cartridge A can therefore be reduced.

After the ink sheet cartridge A is loaded in the recording cover 11 as shown in FIG. 7B, said cover 11 is closed and latched with the main body 10 by mutual engagement of a hook 30*a* thereof with a hook 30*b* of the recording cover.

In this state, the reel gears 2*c*, 3*c* integrally formed with the reels 2, 3 mesh with driving gears 31 provided in the main body 10.

In the main body 10 of the recording apparatus B there are provided reel driving motors 32 as shown in FIG. 7B, and the driving force thereof is transmitted through gears 33*a*–33*e* to the driving gears 31. Said gear 33*e* is mounted on an arm 34 rotatable about the gear shaft 34*a* of the gear 33*d* and constitutes so-called pendulum gear, capable of swinging around said gear 33*d* while meshing with the same. The driving gear 31 can move integrally with said pendulum gear 33*e* and receives the rotating force of said gear 33*d* through a slip clutch 35.

Tension springs 36 are provided for pulling the arms 34 upwards. There is also provided a platen motor 37 for rotating the platen roller 6b through gears 38a–38c.

Figure 11A:
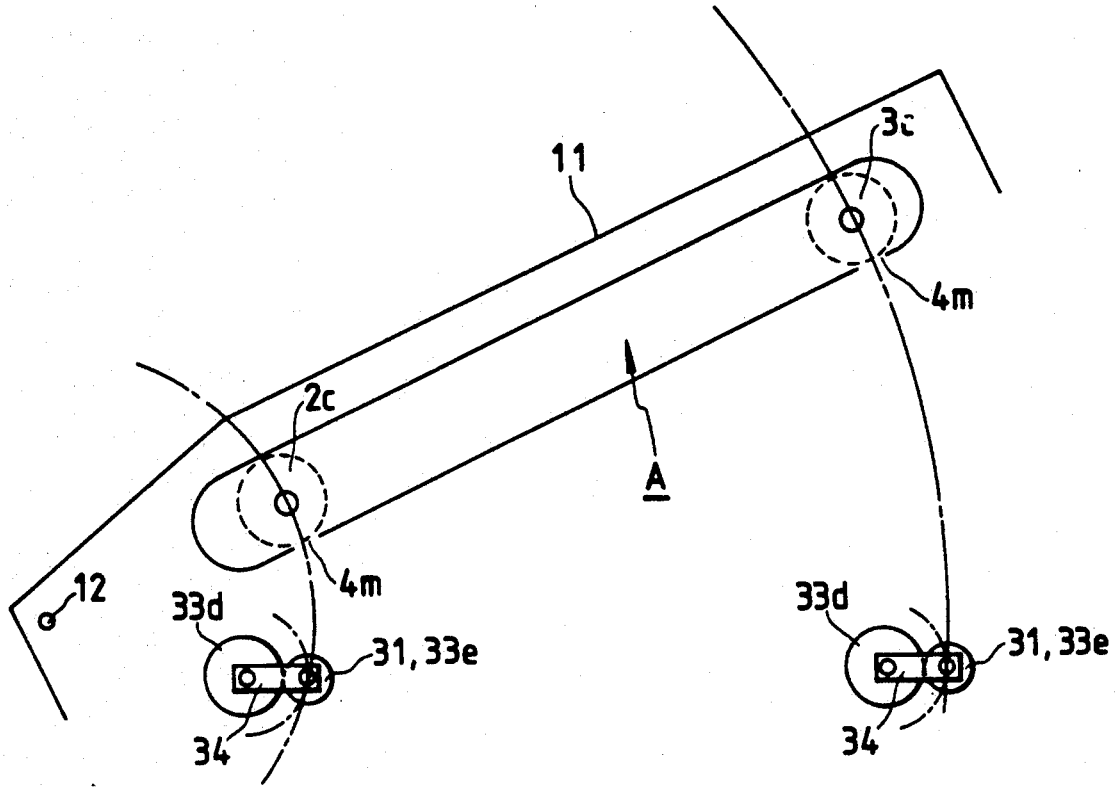
FIGS. 11A and 11B are schematic views showing the relationship between a reel gear and a pendulum gear in closing the, recording cover.
Figure 11B:
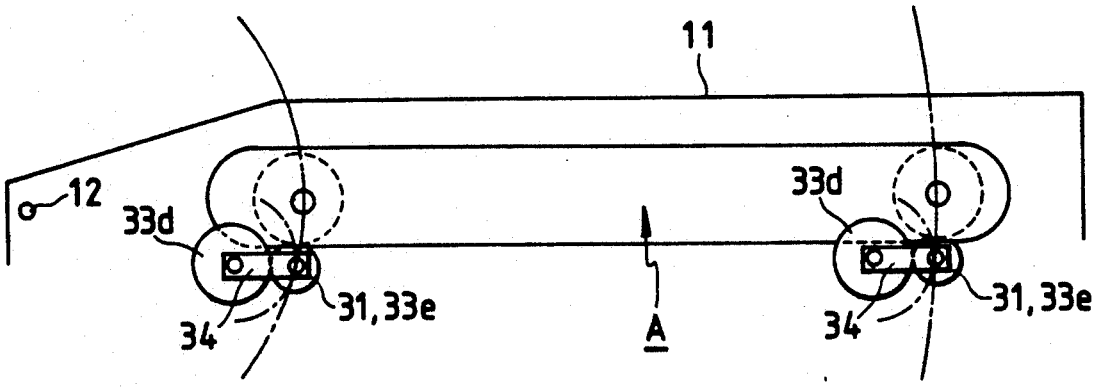

When the recording cover 11 is closed in the above-explained structure, the reel gears 2c, 3c exposed in the apertures 4m of the ink sheet cartridge A mesh with the driving gears 31. In the present embodiment, said apertures 4m are positioned, as shown in FIGS. 11A and 11B, on rotating trajectories of the reel gears 2c, 3c about the hinge shaft 12 of the recording cover 11, and said driving gears 31 are also positioned on said trajectories. Consequently, when the recording cover 11 is closed, the gears 2c, 3c exposed in said apertures 4m press the driving gears 31, thus securely meshing therewith. In this state, even if the mother gears 33d linked to the motors 32 are in locked state, the recording cover 11 can be smoothly closed since the pendulum gears 33e integrally moving with the driving gears 31 can smoothly swing around the mother gears 33d.

Figure 9B:
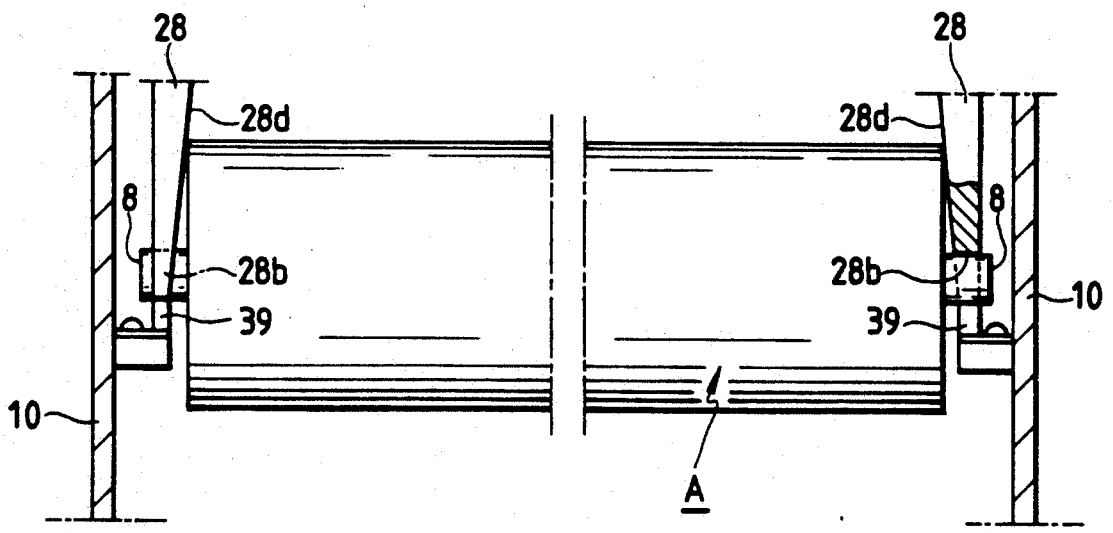

In the main body 10, as shown in FIG. 7B, there are provided plate springs 39 in positions opposed to the bearings 8 of the cartridge A, which is loaded in the recording cover 11, whereby said bearings 8 are pressed toward the U-shaped grooves 28b, 28c of the positioning members 28 by means of said plate springs 39. Thus, as shown in FIG. 9B, the bears 8 are securely positioned in the direction of height (direction Z in FIG. 7B). Said plate springs 39 are positioned corresponding to the U-shaped grooves 28b, 28c across the reel shaft, as shown in FIG. 9B, since otherwise the bearings 8 is subjected to torsion, causing unnecessary friction in the rotation of the reels 2, 3.

The bearings 8 are thus positioned in the U-shaped grooves 28b, 28c of the positioning members 28, independently from the positioning of the ink sheet cartridge A in the recording cover 11. Stated differently, the direct positioning of said bearings 8 on the recording apparatus without through the cartridge A allows to improve the precision, for example of parallel arrangement between the reels 2, 3 and the platen roller 6b. Rigidity or precision is not required for the cartridge A itself, as the positional precision of the bearings 8 is not achieved by said cartridge A. For this reason the cartridge A can be manufactured inexpensively.

In the present embodiment, when the recording cover 11 is closed, the contact position between the recording head 6a and the platen roller 6b is located at approximate center of the cartridge A in the direction of height, as shown in FIG. 10B. If said contact position is located higher in the cartridge A, the recesses $4l_2$ shown in FIG. 1 for accommodating the shaft of the platen roller 6b have to be made deeper, so that the second casing member 4b becomes mechanically weaker. On the other hand, if said contact position is lower in the ink sheet cartridge A, the aperture 4f has to be made larger for accepting the recording head 6a. However, in the present embodiment, said contact position is approximately located at the center so that the aperture 4f can be minimized in size without sacrificing the strength of the second casing member 4b.

In the following there will be explained the recording operation of the recording apparatus B in which the ink sheet cartridge A is loaded.

In the recording operation, the platen motor 37 and the reel driving motor 32 of the take-up reel are driven while the motor 32 of the supply reel is locked. By the activation of said platen motor 37, the platen roller 6b is rotated in a direction a in FIG. 12, thereby advancing the recording sheet 7 and the superposed ink sheet 1 respectively in directions b, c. In synchronization, the heat generating elements $6a_1$ of the recording head 6a are energized according to the image signals to heat the ink sheet 1 imagewise, thereby transferring the fused ink to the recording sheet 7.

In said recording operation, the reel driving motor 32 for the take-up reel 3 drives the reel 3 with a peripheral speed slightly larger than that of the platen roller 6b in order to avoid the slack in the ink sheet 1 advanced by said platen roller 6b, and the speed difference is absorbed by the slip clutch 35. Thus the ink sheet 1 is taken up on the reel 3 under a front tension. On the other hand, since the reel driving motor 32 for the supply reel 2 is locked, the supply reel 2 is subjected to the slipping load of the slip clutch 35, and rotates according to the advancement of the ink sheet 1, thereby giving a back tension thereto.

Figure 12:
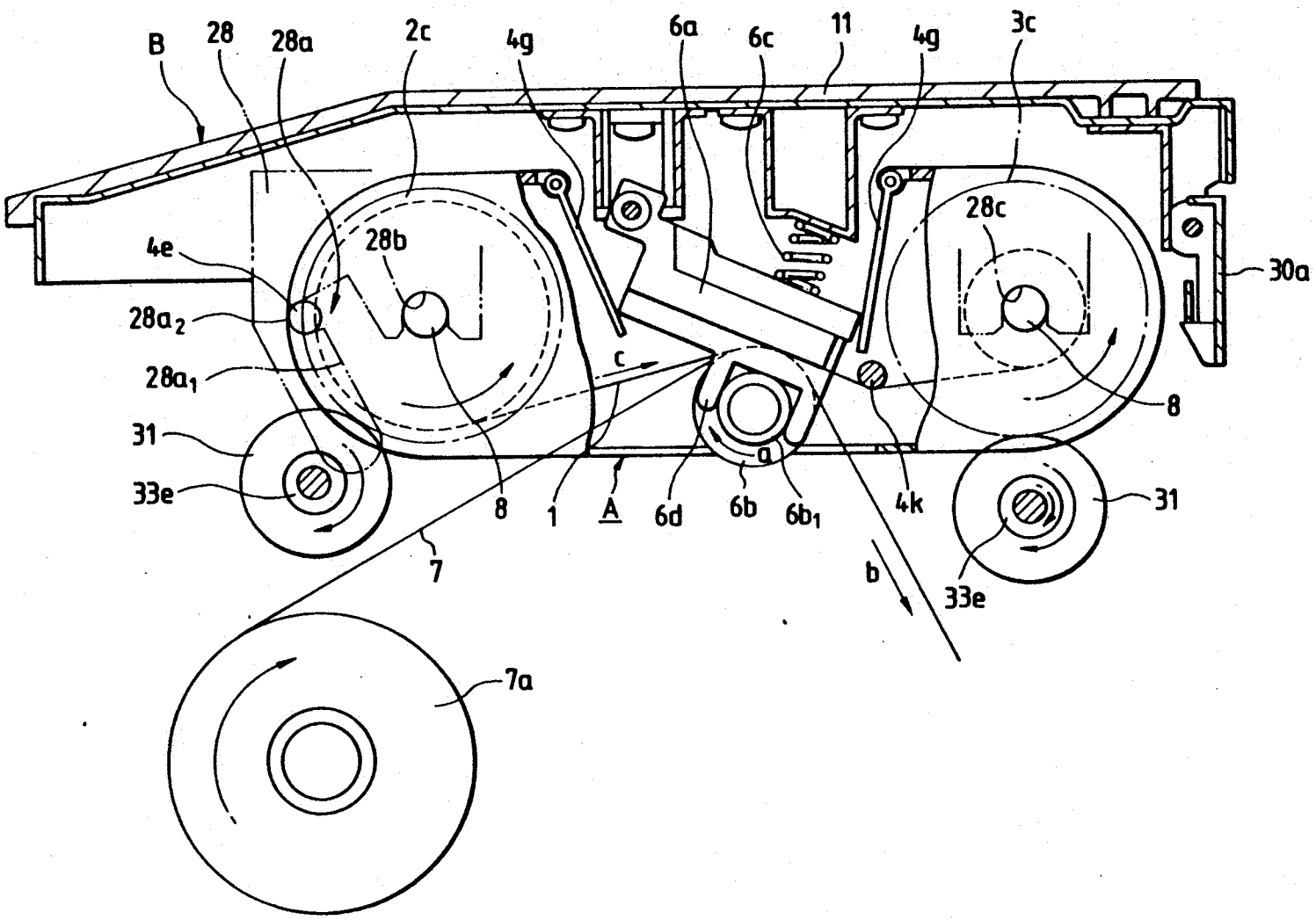
FIG. 12 is a cross-sectional view in a recording operation.

Referring to FIG. 12, if the front tension of the ink sheet 1 in winding on the take-up reel 3 is strong enough to push the recording head 6a upwards, the pressure thereof on the platen roller 6b may fluctuate, eventually resulting in failure in the image transfer. In the present embodiment, however; since the ink sheet 1 after recording is guided, by the guide shaft 4k positioned lower than the recording position R between the head 6a and the platen roller 6b, downwards from said position R, so that the recording head 6a is not pushed upwards by the ink sheet 1 even if the front tension thereof is strong. Consequently the recording head 6a applies a constant pressure on the platen roller 6b, without the fear of failure in image transfer. As already explained before, said guide shaft 4k may be provided either in the ink sheet cartridge A or in the recording cover 11.

Also as shown in FIG. 12, the reel gear 2c of the supply reel 2 is biased upwards by the idling rotation of the driving gear 31 subjected to the slip load, but the bearings 8 do not move upwards as they are supported by the U-shaped grooves 28b, 28c from above. Thus, since the U-shaped grooves 28b, 28c are formed in such a direction as to limit the movement of the reel gears 2c, 3c biased by the driving gears 31, the reel gears 2c, 3c are prevented from such movement and from disengagement from the driving gears 31.

In the following there will be explained the replacement of the ink sheet cartridge A or the detachment thereof from the recording cover 11.

For this purpose, the recording cover 11 is opened as shown in FIG. 7B, and the cartridge A is pulled toward front by the grips 4o, whereby the projection 4n of the cartridge A is disengaged from the spring 29. Thus the cartridge A rotates about the guide pins 4e as shown in FIG. 7A and can be easily detached from the recording cover 11. Since the grips 4o and the engaging projection 4n are both provided on the second casing member 4b, the pulling action on said grips 4o does not apply any force on the engagement between the recesses 4p of the first casing member 4a and the projections 4q of the second casing member 4b. This fact prevents undesired opening of the first and second casing members 4a, 4b in the disengagement of the projection 4n from the spring 29.

As detailedly explained in the foregoing, the ink sheet cartridge A of the present embodiment can be easily loaded, with sufficient positional precision, into the recording apparatus B equipped with the recording head 6a, and ensures recording of high image quality, by securely avoiding the slippage or disengagement of gears in the transmission system.

Another Embodiment

Figure 13:
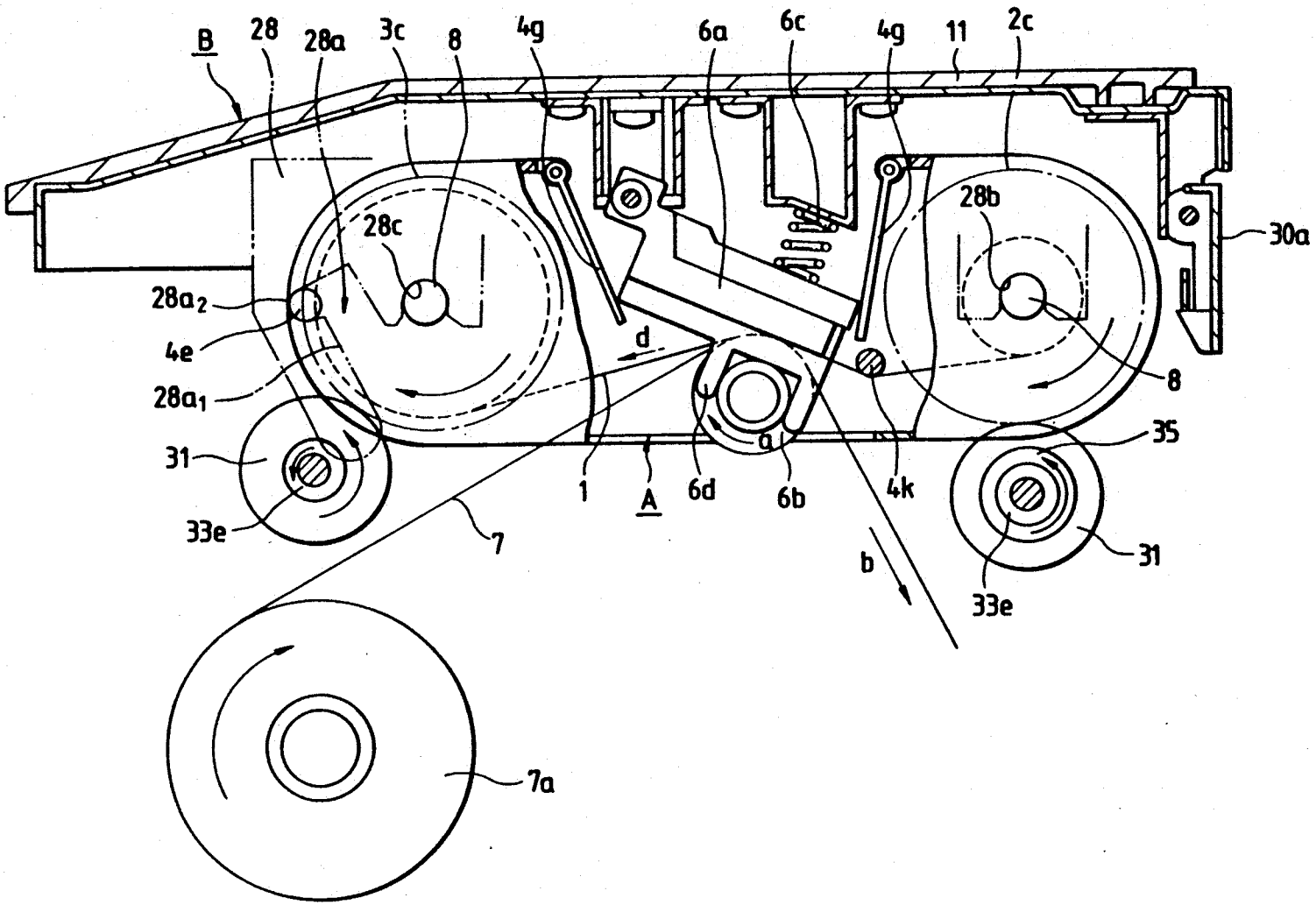
FIG. 13 is a schematic view of an embodiment in which the feeding direction of the ink sheet is reversed.

In the foregoing first embodiment, the ink sheet 1 is advanced in the same direction as the recording sheet 7 in the recording operation, but it is also possible, as shown in FIG. 13, to feed the ink sheet 1 in a direction d opposite to the feeding direction b of the recording sheet 7.

In such case, the structure of the ink sheet cartridge A is same as that in the foregoing first embodiment, except that the supply reel 2 and the take-up reel 3 are inverted.

In this structure, the reel gear 3*c* of the take-up reel 3 is linked to the driving motor through the gears but without the slip clutch. In the recording operation with this structure, the recording sheet 7 is advanced in a direction a by the platen roller 6*b* while the ink sheet 1 is advanced in a direction d by the reel driving motor of the take-up reel. The gears coupled with the reel gear 2*c* of the supply reel 2 are provided with a slip clutch 35, whereby the reel 2 is subjected to a slip load, thus a back tension to the ink sheet 1.

Also in the foregoing first embodiment, the U-shaped grooves 28*b*, 28*c* for positioning the bearings 8 are provided in the recording cover 11, but they may be provided in the main body 10. Such embodiment will be explained in the following with reference to FIGS. 14A, 14B, 15, 16A, 16B, 17A, 17B and 18, wherein same components as those in the foregoing embodiment are represented by same numbers and will not be explained further.

Figure 14A:
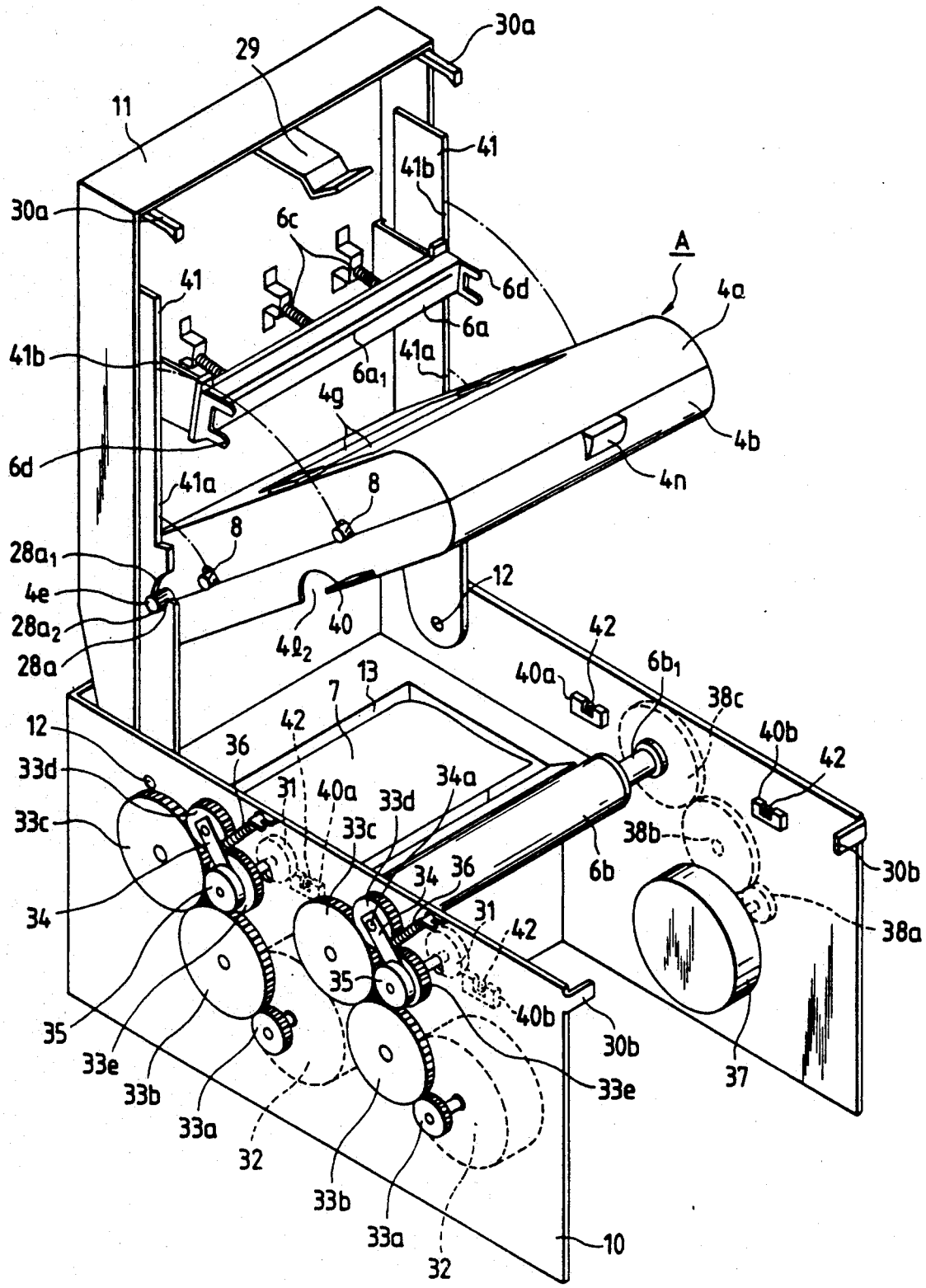
Figure 14B:
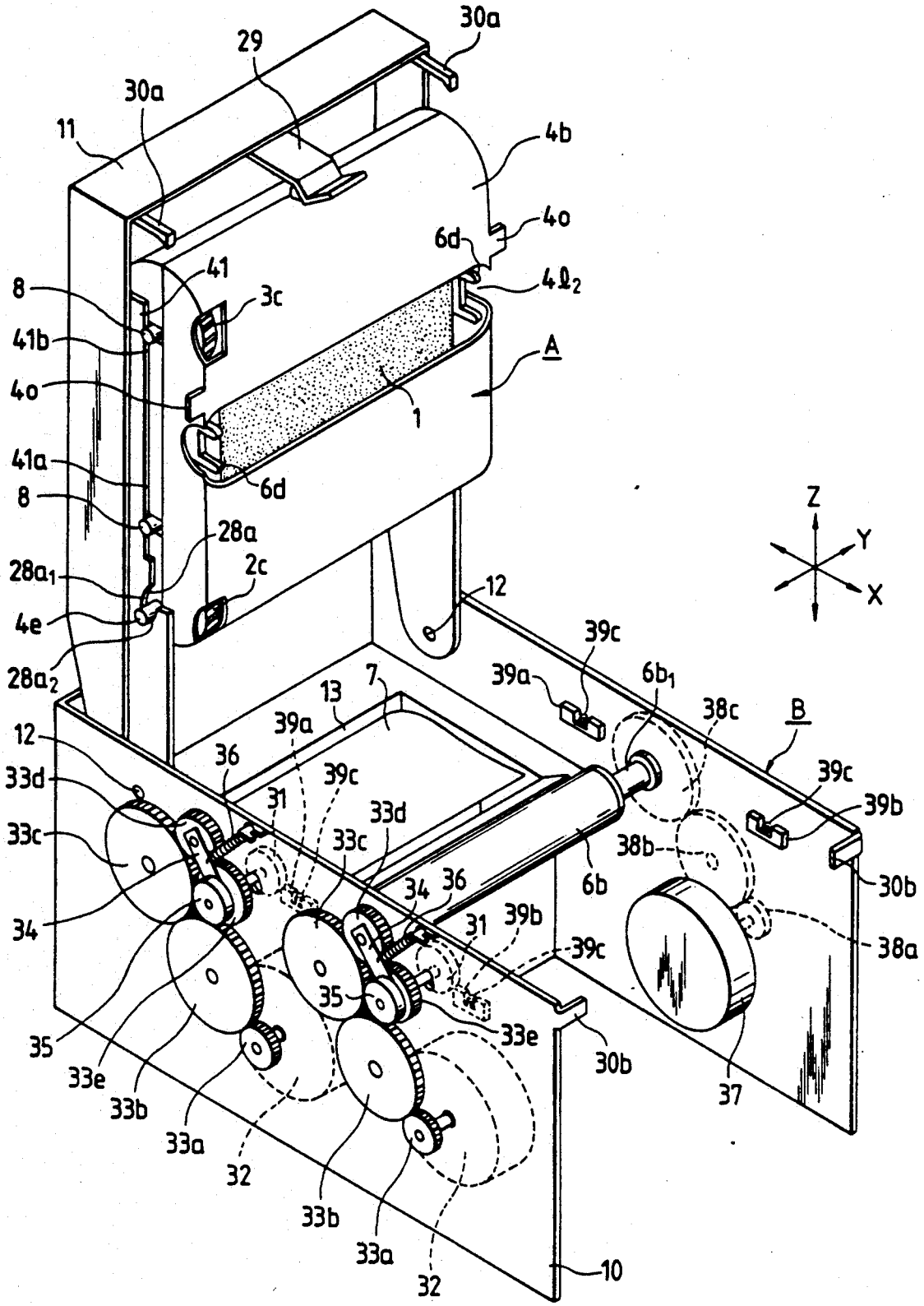
Figure 15:
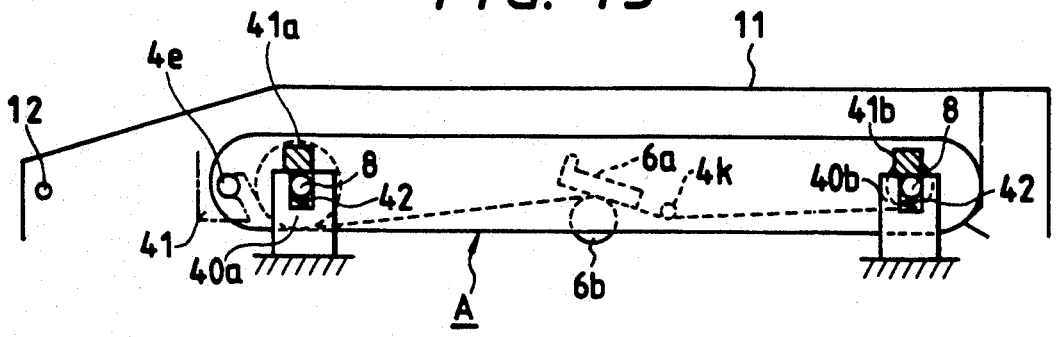
Figure 16A:
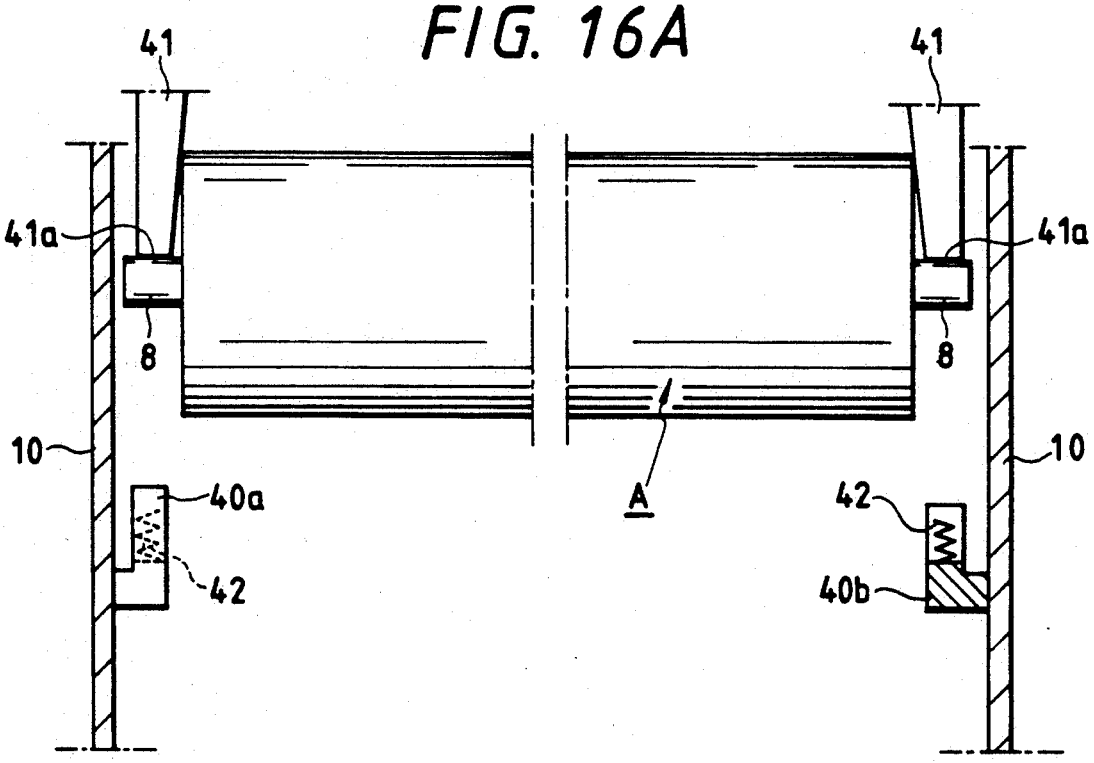
Figure 16B:
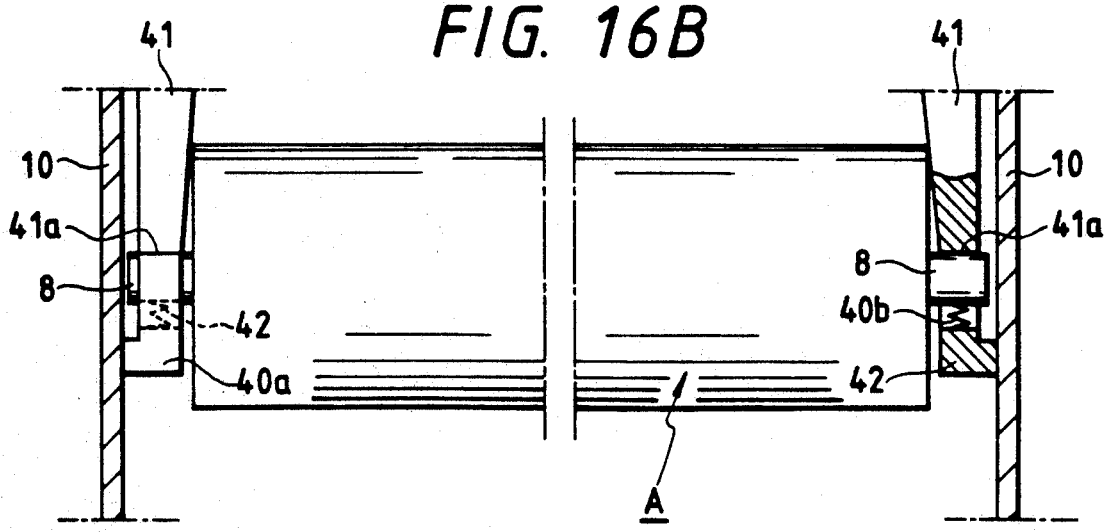
Figure 17A:
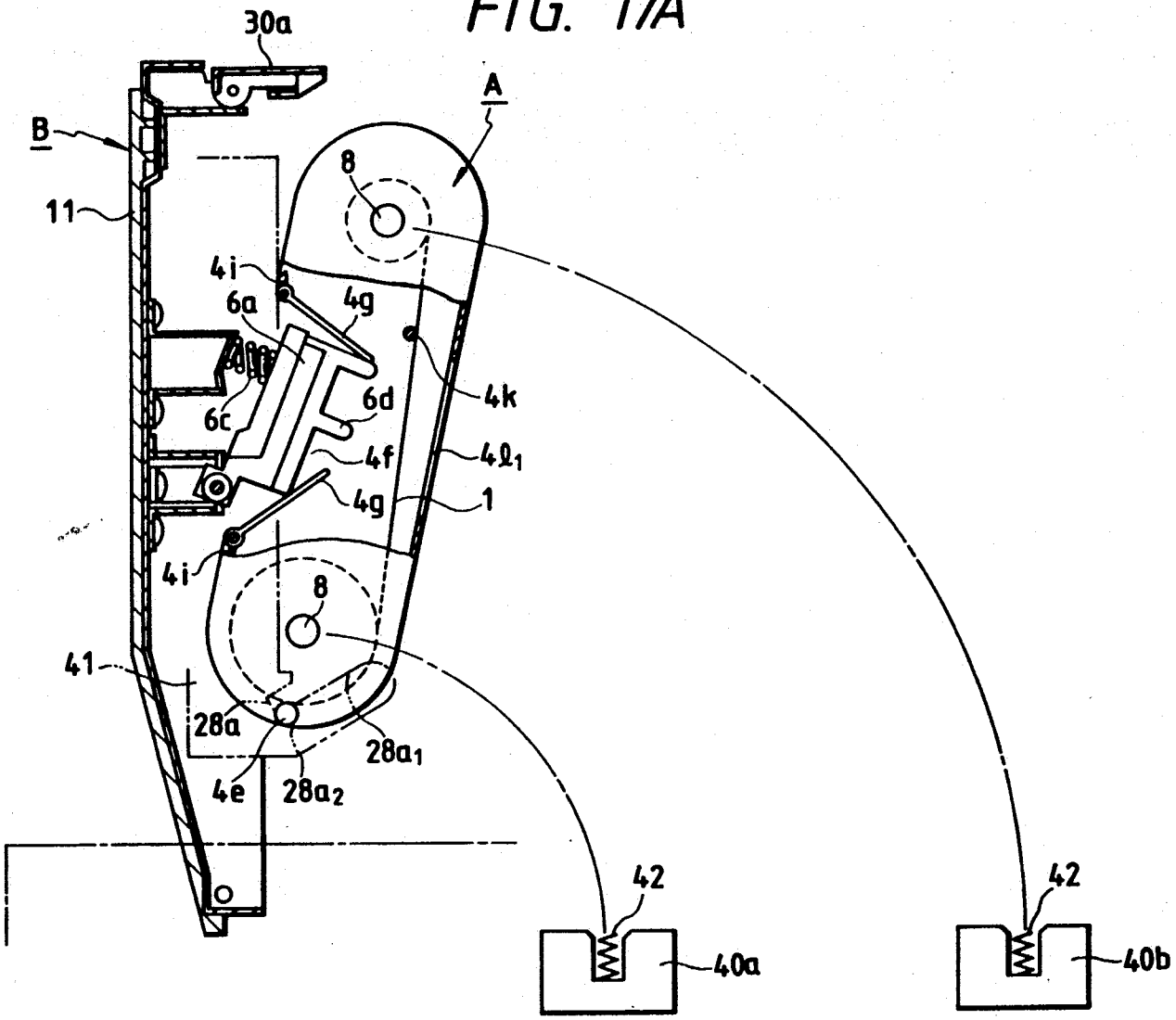
Figure 17B:
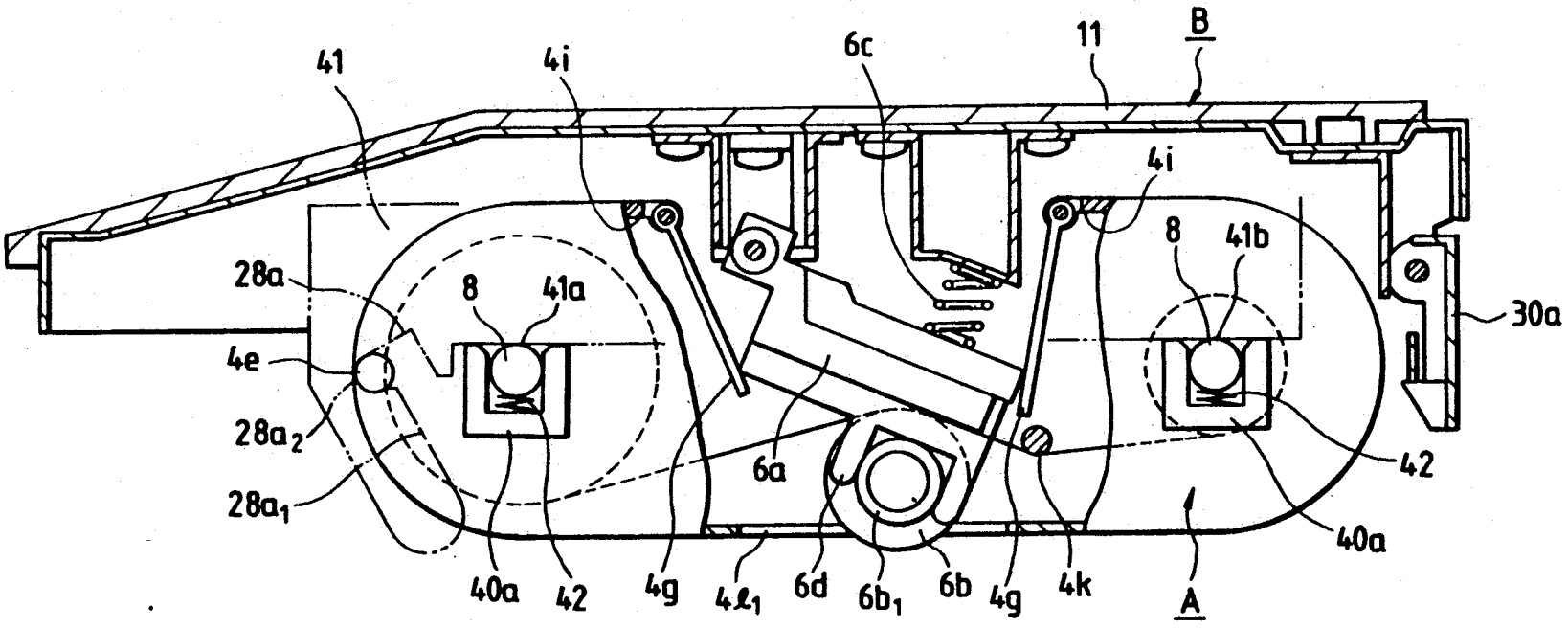
Figure 18:
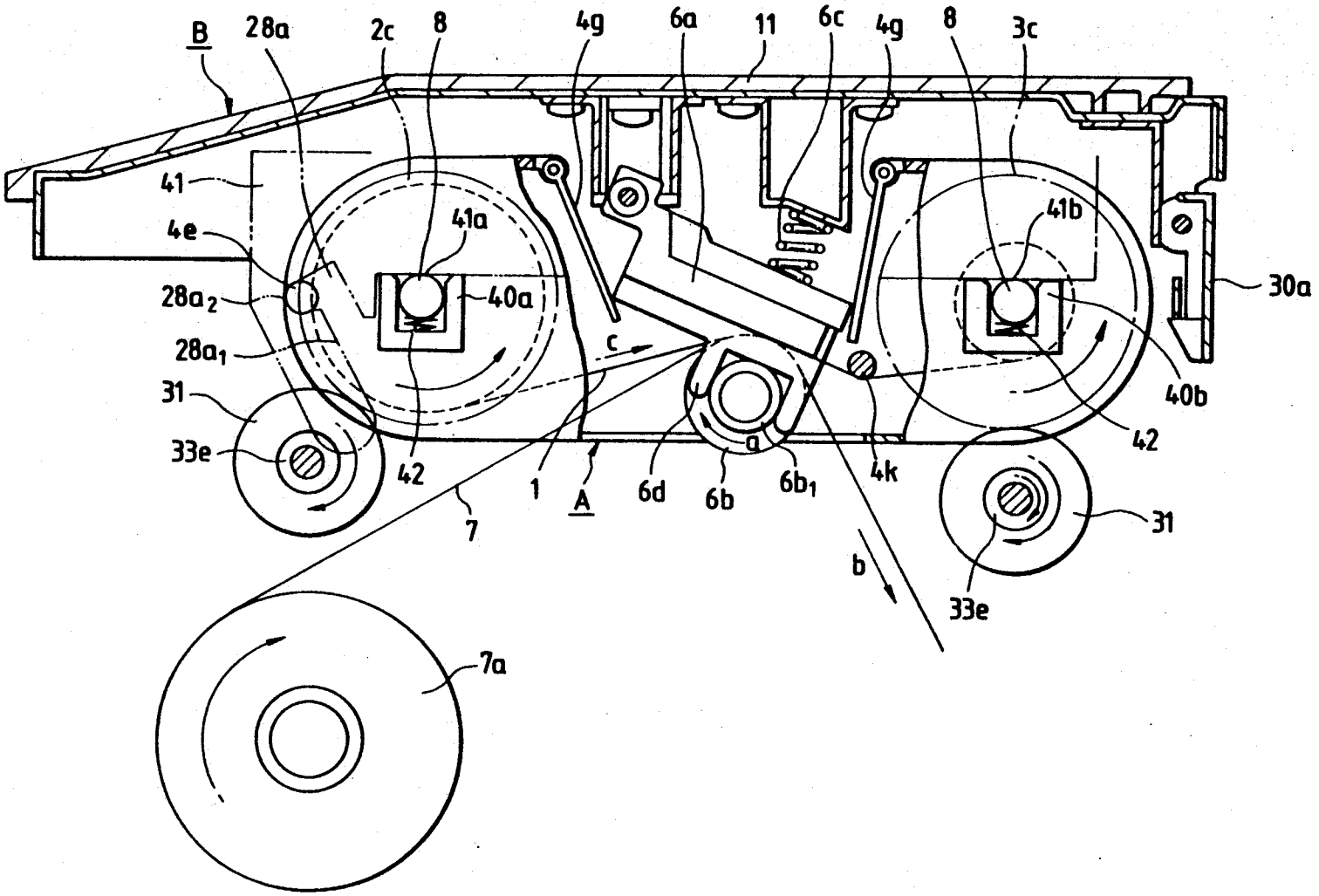
Figure 19:
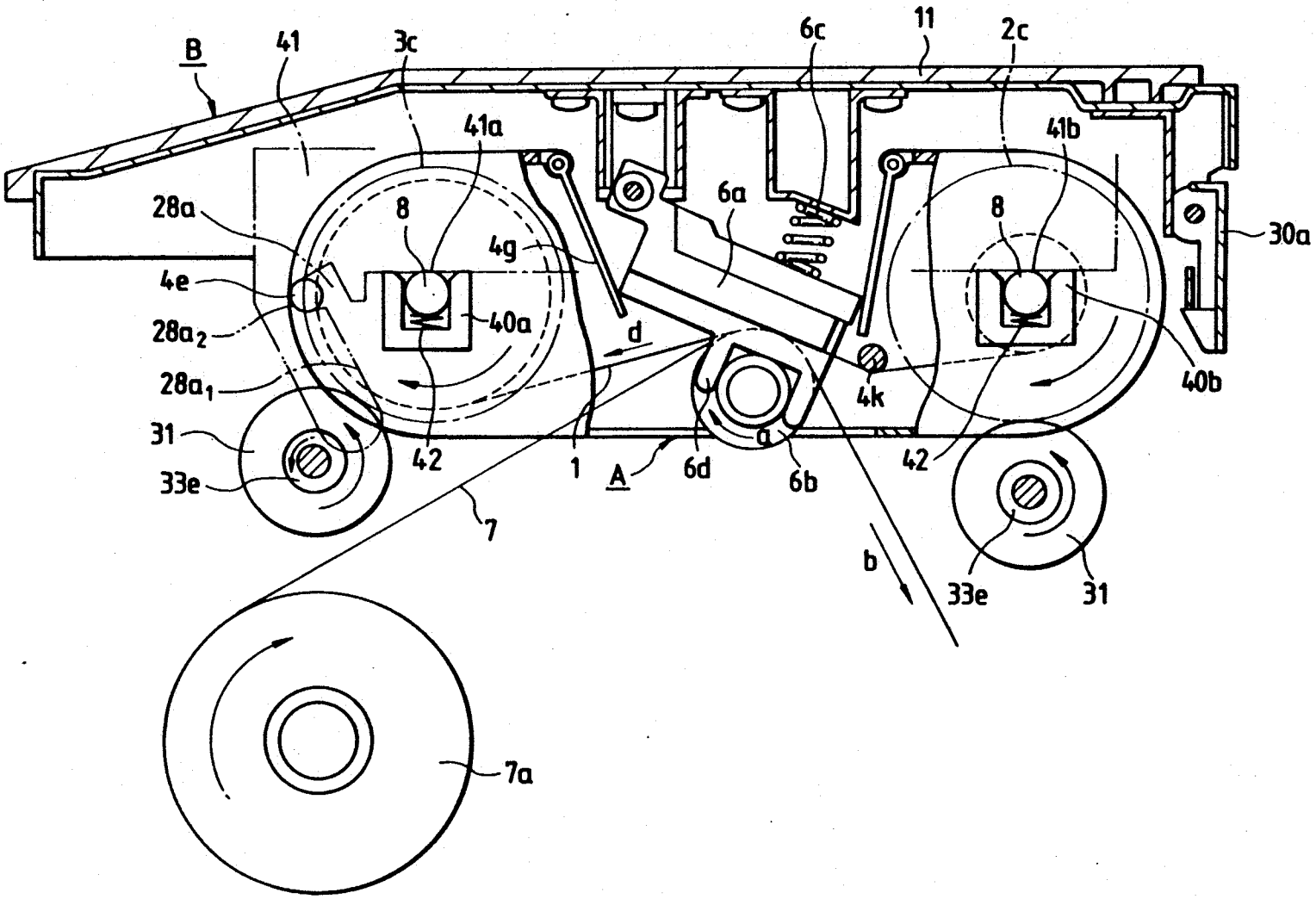

FIGS. 14A and 14B show a state of cartridge loading into the recording apparatus, corresponding to FIGS. 7A and 7B; FIGS. 15, 16A and 16B shows a state with closed recording cover, corresponding to FIGS. 9A and 9B; FIGS. 17A and 17B show the relationship between the recording head and the cover corresponding to FIGS. 10A and 10B; FIG. 18 shows a recording state corresponding to FIG. 12; and FIG. 19 shows a schematic view of an embodiment in which the feeding direction of the ink sheet is reversed, corresponding to FIG. 19.

As shown in FIGS. 14A, 14B, 16A and 17A, U-shaped grooves 40*a*, 40*b* for positioning the bearings 8 of the supply reel 2 and take-up reel 3 are provided in predetermined positions of the main body 10, while positioning members 41 only having the hooked grooves 28*a* for positioning the guide pins 4*e* of the ink sheet cartridge A are provided on the recording cover 11. Also on said cover there is provided the spring 29 for engaging with the projection 4*n* of the cartridge A.

Consequently the cartridge A can be loaded in the recording cover 11 as in the foregoing embodiment, by fitting the guide pins 4*e* into the hooked grooves 28*a* and engaging the projection 4*n* with the spring 29. Then the recording cover 11 is closed, whereby, as shown in FIGS. 15, 16B and 17B, the bearings 8 are fitted and positioned in the U-shaped grooves 40*a*, 40*b* provided in the main body 10. As shown in FIG. 15, springs 42 are provided in said U-shaped grooves 40*a*, 40*b* for maintaining the upper ends of the bearings 8 in contact with contact portions 41*a*, 41*b* of the positioning members 41 when the recording cover 11 is closed.

By forming the positioning means for the bearings 8 in the main body 10 on which the platen roller 6*b* is mounted, it is easily possible to achieve a highly precise parallel relationship between the platen roller 6*b* and the reels 2, 3 positioned by said U-shaped grooves 40*a*, 40*b*.

Also, even if the reel gears 2*c*, 3*c* are pushed upwards in FIG. 15 by the driving gears 31 as in the first embodiment, the disengagement of gears does not occur since the bearings 8 are prevented from movement in the vertical direction, in contact with the contact portions 41*a* and 41*b*.

Also in the foregoing embodiment, it is possible to feed the ink sheet 1 in a direction d opposite to the feeding direction b of the recording sheet 7 as shown in FIG. 19.

As detailedly explained in the foregoing, the present invention provides an ink sheet cartridge capable of image recording of high quality, and a recording apparatus utilizing said ink sheet cartridge.

What is claimed is:

1. An ink sheet cartridge adapted to be loaded in a recording apparatus for recording on a recording medium utilizing an ink sheet, comprising:

first winding means for winding the ink sheet thereon, the first winding means being disposed in a first direction;

second winding means for winding the ink sheet thereon;

a frame member, said frame member supporting said first and said second winding means; and a projecting guide member provided on said frame member in a position close to an extension of a line connecting said first and said second winding means and projecting outwardly from said frame member in a direction substantially parallel to the first direction in which the first winding means is provided and serving as a guide when loading said cartridge into the recording apparatus.

2. An ink sheet cartridge comprising:

a supply reel for supplying an ink sheet;

a winding reel for winding the ink sheet;

a container comprising a first casing member and a second casing member, the first and the second casing members being openable relative to each other and rotatably connected to each other; and a projecting guide member provided on said container in a position close to an extension of a line connecting said supply reel and said winding reel, said projecting guide member serving as a guide when loading said cartridge into a recording apparatus, wherein a plurality of grooves for fitting said supply reel and said winding reel and a guide pin serving as a guide when loading said container into the recording apparatus are formed in at least one of the first and the second casing members of said container.

3. An ink sheet cartridge adapted to be loaded in a recording apparatus for recording an image on a recording medium utilizing an ink sheet, comprising:

first winding means for winding the ink sheet thereon;

second winding means for winding the ink sheet thereon;

a frame member, said frame member movably supporting said first and said second winding means while permitting their movement, including rotation;

positioning means for defining a position of said first and a position of said second winding means with respect to the recording apparatus when loading said cartridge therein;

a projecting guide member provided on said frame member in a position close to an extension of a line connecting said first and said second winding means, said projecting guide member serving as a guide when loading said cartridge into the recording apparatus; and an engaging member for engaging said frame member with the recording apparatus when loading of said frame member into the recording apparatus.

4. An ink sheet cartridge having a frame and adapted to be loaded in a recording apparatus for image recording on a recording medium utilizing an ink sheet, comprising:

a supply reel for supplying the ink sheet;

a winding reel for winding the ink sheet;

a plurality of bearings rotatably mounted on said supply reel and said winding reel, said bearings being shiftably mounted so that they are shiftable relative to the frame of the cartridge and adapted to be positioned by positioning means of the recording apparatus;

a projecting guide member provided on the frame in a position close to an extension of a line connecting said supply reel and said winding reel, said projecting guide member serving as a guide when loading the cartridge into the recording apparatus; and a container for supplying said bearings.

5. An ink sheet cartridge having a frame and adapted to be loaded in a recording apparatus for image recording on a recording medium utilizing an ink sheet, comprising:

a supply reel for supplying the ink sheet;

a winding reel for winding the ink sheet;

a plurality of reel gears provided such that said supply reel and said winding reel each have at least one said reel gear;

a projecting guide member provided on the frame in a position close to an extension of a line connecting said supply reel and said winding reel, said projecting guide member serving as a guide when loading said cartridge into the recording apparatus; and a container for supporting said supply reel and said winding reel, said container being provided with apertures for exposing said reel gears;

wherein said container is loadable in a recording cover of the apparatus, and the apertures are positioned in said recording cover such that when said recording cover is opened, a plurality of rotary trajectories are described by said reel gears, said apertures being disposed on the rotary trajectories of said reel gears.

6. An ink sheet cartridge according to claims 1, 2, 3, 4 or 5, wherein the position of the projecting guide member is a position not more than about 10 mm from the extension of the line.

7. An ink sheet cartridge according to claim 1, 2, 3, 4 or 5, wherein the position of the projecting guide member is a position not more than about 5 mm from the extension of the line.

8. An ink sheet cartridge according to claims 1, 2, 3, 4 or 5, wherein the position of the projection guide member is a position nor more than about 2.5 mm from the extension of the line.

9. An ink sheet cartridge according to claims 1, 2, 3, 5 or 5, wherein the position close to the extension of the line means a position not separated by more than about 10 mm from the extension of the line.

10. An ink sheet cartridge according to claims 1, 2, 3, 4 or 5, wherein the position close to the extension of the line means a position not separated by more than about 5 mm from the extension of the line.

11. An ink sheet cartridge according to claims 1, 2, 3, 4 or 5, wherein the position close to the extension of the line means a position not separated by more than about 2.5 mm from the extension of the line.

12. An ink sheet cartridge according to claims 1, 2, 3, 4 or 5, wherein the position of the projecting guide member is approximately on the extension of the line.

13. An ink sheet cartridge according to claims 1, 2, 3, 4 or 5, wherein the position close to the extension of the line is approximately on the extension of the line.

14. An ink sheet cartridge according to claim 3, wherein said positioning means is selected from a group consisting of a bearing and an ink sheet reel.

15. An ink sheet cartridge according to claim 3, wherein said engaging means comprises a flexible catch formed from a strip of material which flexes from a first position, in which said cartridge is securely held, and a second position in which said cartridge can be removed, the strip taking the first position in the absence of an external force.

16. A recording apparatus for image recording on a recording medium, comprising:

a loading unit for loading therein an ink sheet cartridge, said cartridge including first winding means for winding an ink sheet thereon, the first winding means being disposed in a first direction;

second winding means for winding the ink sheet thereon;

a frame member, the frame member supporting the first and the second winding means; and a projecting guide member provided on the frame member in a position close to an extension of a line connecting the first and the second winding means, the projecting guide member projecting outwardly from the frame member in a direction substantially parallel to the first direction and serving as a guide when loading said ink sheet cartridge into said recording apparatus;

recording means for recording an image on the recording medium by acting on the ink sheet provided in said ink sheet cartridge loaded in said loading unit;

first feeding means for feeding the ink sheet; and second feeding means for feeding the recording medium.

17. A recording apparatus for image recording on a recording medium, comprising:

a loading unit for loading therein an ink sheet cartridge, said cartridge comprising;

first winding means for winding an ink sheet thereon;

second winding means for winding the ink sheet thereon;

a frame member, the frame member movably supporting the first and the second winding means while permitting their movement, including rotation;

a positioning member for defining a position of the first and a position of the second winding members with respect to said recording apparatus when loading said cartridge therein;

a projecting guide member provided on the frame member in a position close to an extension of a line connecting the first and the second winding means, the projecting guide member serving as a guide when loading said cartridge into the recording apparatus; and an engaging member for engaging said frame member with the recording apparatus when loading said frame member into said recording apparatus;

positioning means for defining a position of the positioning member provided on the ink sheet cartridge;

engaging means for engaging with the engaging member;

ink sheet feeding means for feeding the ink sheet.

18. A recording apparatus for image recording by loading an ink sheet cartridge having a frame member, an ink sheet, a supply reel for supplying the ink sheet, a winding reel for winding the ink sheet, and a projecting guide member provided on the frame member in a position close to an extension of a line connecting the supply reel and the winding reel, the projecting guide member serving as a guide when loading the cartridge into said recording apparatus, said recording apparatus comprising:

a main body;

a recording cover which can be opened and closed relative to said main body; and a recording head for heating the ink sheet contained in the ink sheet cartridge according to image signals;

wherein the supply reel and the winding reel are shiftable relative to the frame member of the cartridge and positioning means for defining the positions of the supply reel and the winding reel is provided in said main body of said recording apparatus.

19. A recording apparatus for image recording on a recording medium, comprising:

loading means for loading therein an ink sheet cartridge comprising first winding means for winding the ink sheet thereon; second winding means for winding the ink sheet thereon; a frame member, the frame member movably supporting the first and the second winding means; and a projecting guide member provided on the frame member in a position close to an extension of a line connecting the first and the second winding means, the projecting guide member serving as a guide when loading the cartridge into said recording apparatus;

recording means for recording, said recording means recording an image on the recording medium by acting on the ink sheet contained in the ink sheet cartridge loaded in said loading unit;

ink sheet feeding means for feeding the ink sheet; and recording medium feeding means for feeding the recording medium.

20. A recording apparatus for image recording on a recording medium comprising:

a loading unit for loading therein an ink sheet cartridge having a frame and including a supply reel for supplying an ink sheet;

a winding reel for winding the ink sheet;

a plurality of bearings rotatably mounted on the supply reel and the winding reel, the bearings being shiftably mounted so that they are shiftable relative to the frame of the cartridge and adapted to be positioned by positioning means for positioning of said recording apparatus;

a projecting guide member provided on the frame in a position close to an extension of a line connecting the first and the second winding means, the projecting guide member serving as a guide when loading the cartridge into said recording apparatus; and a container for supporting the bearings;

recording means for acting on the ink sheet contained in the ink sheet cartridge loaded in said loading unit;

ink sheet feeding means for feeding the ink sheet; and recording medium feeding means for feeding the recording medium.

21. A recording apparatus for image recording on a recording medium, comprising:

first winding means for winding an ink sheet thereon;

second winding means for winding the ink sheet thereon;

driving force receiving means for receiving a driving force respectively provided on said first winding means and said second winding means;

transmission means for transmitting the driving force to a plurality of driving force receiving members for receiving the driving force, the driving force receiving means being pivotably provided along a plurality of arcs, the arcs being rotary trajectories described by the driving force receiving members during a closing operation of a main body of said recording apparatus; and a projecting guide member provided on a frame member in a position close to an extension of a line connecting said first and said second winding means, said projecting guide member serving as a guide when loading said first winding means and said second winding means into said recording apparatus;

ink sheet feeding means for feeding the ink sheet;

recording medium feeding means for feeding the recording medium; and recording means for recording an image on the recording medium using the ink sheet.

22. A recording apparatus according to claim 17, wherein said positioning means is selected from a group consisting of a bearing and an ink sheet reel.

23. A recording apparatus according to claim 17, wherein said engaging member comprises a flexible catch formed from a strip of material which flexes from a first position, in which said cartridge is securely held, and a second position in which said cartridge can be removed, said strip taking said first position in the absence of an external force.

24. A recording apparatus according to claim 16, 17, 18, 19, 20 or 21, wherein the position of the projecting guide member is a position not more than about 10 mm from the extension of the line.

25. A recording apparatus according to claims 16, 17, 18, 19, 20 or 21, wherein the position of the projecting guide member is a position not more than about 5 mm from the extension of the line.

26. A recording apparatus according to claims 16, 17, 18, 19, 20 or 21, wherein the position of the projecting guide member is a position not more than about 2.5 mm from the extension of the line.

27. A recording apparatus according to claims 16, 17, 18, 19, 20 or 21, wherein the position close to the extension of the line means a position not separated by more than about 10 mm from the extension of the line.

28. A recording apparatus according to claims 16, 17, 18, 19, 20 or 21, wherein the position close to the extension of the line means a position not separated by more than about 5 mm from the extension of the line.

29. A recording apparatus according to claims 16, 17, 18, 19, 20 or 21, wherein the position close to the extension of the line means a position not separated by more than about 2.5 mm from the extension of the line.

30. A recording apparatus according to claims 16, 17, 18, 19, 20 or 21, wherein the position of the projecting guide member is approximately on the extension of the line.

31. A recording apparatus according to claims 16, 17, 18, 19, 20 or 21, wherein the position close to the extension of the line is approximately on the extension of the line.

32. A recording apparatus according to claim 21, wherein said first winding means, said second winding means and said driving force receiving members are provided in a cover which can be opened or closed with respect to a main body of said recording apparatus equipped with said transmission means.

33. A recording apparatus according to claim 18, wherein the recording cover is provided with a contact portion for contacting with the supply reel and said winding reel.

* * * * *

UNITED STATES PATENT AND TRADEMARK OFFICE

CERTIFICATE OF CORRECTION

PATENT NO. : 5,243,360

DATED : September 7, 1993

INVENTOR(S) : Akihiro Tomoda, et al.

It is certified that error appears in the above-indentified patent and that said Letters Patent is hereby corrected as shown below:

ON TITLE PAGE

In [56] References Cited, under FOREIGN PATENT DOCUMENTS:
"59-207254 4/1985 Japan ." should read
--59-207254 11/1984 Japan .--.

COLUMN 1

Line 20, "home." should read --homes.--.
Line 49, "dusts" should read --dust--.

COLUMN 2

Line 61, "the," should read --the--.

COLUMN 4

Line 64, "aperture $fl_1$" should read --aperture $4l_1$--.

COLUMN 5

Line 42, "reel" should read --reel.--.
Line 63, "dusts" should read --dust--.
Line 67, "high-classed" should read --high-class--.

COLUMN 7

Line 44, "19B, so" should read --19B), so--.

UNITED STATES PATENT AND TRADEMARK OFFICE

CERTIFICATE OF CORRECTION

PATENT NO. : 5,243,360

DATED : September 7, 1993

INVENTOR(S) : Akihiro Tomoda, et al.

It is certified that error appears in the above-indentified patent and that said Letters Patent is hereby corrected as shown below:

COLUMN 9

Line 26, "bears" should read --bearings--.
Line 30, "is" should read --are--.

COLUMN 11

Line 36, "shows" should read --show--.

COLUMN 13

Line 64, "projection" should read --projecting--.
Line 65, "nor" should read --not--.
Line 68, "5 or 5," should read --4 or 5,--.

COLUMN 14

Line 21, "means" should read --member--.
Line 56, "comprising;" should read --comprising:--.

COLUMN 15

Line 15, "member;" should read --member; and--.
Line 55, "loading unit;" should read --loading means;--.

UNITED STATES PATENT AND TRADEMARK OFFICE

CERTIFICATE OF CORRECTION

PATENT NO. : 5,243,360

DATED : September 7, 1993

INVENTOR(S) : Akihiro Tomoda, et al.

It is certified that error appears in the above-indentified patent and that said Letters Patent is hereby corrected as shown below:

COLUMN 18

Line 12, "the" should read --said--.
Line 13, "said" should read --the--.

Signed and Sealed this

Tenth Day of January, 1995

Bruce Lehman

*Attest:*

BRUCE LEHMAN

*Attesting Officer*

*Commissioner of Patents and Trademarks*